US009969581B2

(12) United States Patent
Kikuta

(10) Patent No.: US 9,969,581 B2
(45) Date of Patent: May 15, 2018

(54) PAPER FEED DEVICE, IMAGE FORMING APPARATUS AND METHOD OF CONTROLLING PAPER FEED DEVICE

(71) Applicant: KYOCERA Document Solutions Inc., Osaka (JP)

(72) Inventor: Tomoyuki Kikuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/603,802

(22) Filed: May 24, 2017

(65) Prior Publication Data

US 2017/0341889 A1 Nov. 30, 2017

(30) Foreign Application Priority Data

May 30, 2016 (JP) ..... 2016-107091
May 31, 2016 (JP) ..... 2016-109065

(51) Int. Cl.

| | |
|---|---|
| ***B65H 1/04*** | (2006.01) |
| ***B65H 1/26*** | (2006.01) |
| ***B65H 7/02*** | (2006.01) |
| ***B41J 13/00*** | (2006.01) |
| ***B65H 1/14*** | (2006.01) |
| ***B65H 9/04*** | (2006.01) |

(Continued)

(52) U.S. Cl.

CPC ..... *B65H 7/02* (2013.01); *B41J 13/0009* (2013.01); *B41J 13/103* (2013.01); *B65H 1/04* (2013.01); *B65H 1/14* (2013.01); *B65H 1/266* (2013.01); *B65H 9/04* (2013.01); *G03G 15/6502* (2013.01); *B65H 2511/10* (2013.01); *B65H 2511/12* (2013.01)

(58) Field of Classification Search

CPC ..... B65H 1/04; B65H 1/266; B65H 1/1412; B65H 7/02; B65H 7/14; B65H 2511/12; B65H 2511/11

See application file for complete search history.

(56) References Cited

U.S. PATENT DOCUMENTS 7,285,965 B2 * 10/2007 Shen ..... B65H 1/04 324/716
7,956,603 B2 * 6/2011 Cochran ..... A61B 5/1126 324/207.17

(Continued)

FOREIGN PATENT DOCUMENTS

JP H 7-61646 A 3/1995
JP H 8-104436 A 4/1996

(Continued)

*Primary Examiner* — Luis A Gonzalez
(74) *Attorney, Agent, or Firm* — Stein IP, LLC

(57) ABSTRACT

A paper feed device includes: a sensor unit that includes a coil substrate and a conductive plate which is opposite the coil substrate, that outputs an output value corresponding to a position of the conductive plate; a first cursor link mechanism which moves the first conductive plate according to the position of the first cursor in the longitudinal direction of the first coil substrate; a storage unit which stores first sheet size data; and a control unit which recognizes the magnitude of the first output value of the sensor unit and which recognizes, based on the recognized magnitude of the first output value and the first sheet size data, the size of the set sheets.

14 Claims, 15 Drawing Sheets

(51) Int. Cl.
*B41J 13/10* (2006.01)
*G03G 15/00* (2006.01)

(56) References Cited

U.S. PATENT DOCUMENTS

| | | | | |
|---|---|---|---|---|
| 8,584,371 | B2 * | 11/2013 | Marumoto | B65H 1/266 271/3.13 |
| 2013/0214478 | A1 * | 8/2013 | Yoshida | B65H 1/00 271/145 |
| 2013/0322900 | A1 * | 12/2013 | Ogawahara | G03G 15/2042 399/45 |
| 2015/0268028 | A1 * | 9/2015 | Hirota | G03G 15/5029 324/207.17 |
| 2016/0101955 | A1 * | 4/2016 | Koseki | B65H 7/04 271/265.02 |

FOREIGN PATENT DOCUMENTS

| | | | | |
|---|---|---|---|---|
| JP | 08175745 | A | * | 7/1996 |
| JP | 2003327334 | A | * | 11/2003 |
| JP | 2007248300 | A | * | 9/2007 |

* cited by examiner

FIG.11

D1

| FIRST OUTPUT VALUE | SIZE(mm) |
|---|---|
| ... | ... |
| X1≦X<X2 | Z1 |
| X2≦X<X3 | Z2 |
| X3≦X<X4 | Z3 |
| X4≦X<X5 | Z4 |
| ... | ... |

FIG.12

D2

| SECOND OUTPUT VALUE | SIZE(mm) |
|---|---|
| ... | ... |
| Y1≦X<Y2 | Z5 |
| Y2≦X<Y3 | Z6 |
| Y3≦X<Y4 | Z7 |
| Y4≦X<Y5 | Z8 |
| ... | ... |

| | THIRD OUTPUT VALUE ~D3 |
|---|---|
| FULL-SHEET VALUE | X1 |
| NO-SHEET VALUE | X2 |

PAPER FEED DEVICE, IMAGE FORMING APPARATUS AND METHOD OF CONTROLLING PAPER FEED DEVICE

This application is based upon and claims the benefit of priority from the corresponding Japanese Patent Application No. 2016-107091 filed on May 30, 2016 and the corresponding Japanese Patent Application No. 2016-109065 filed on May 31, 2016, the entire contents of which are incorporated herein by reference.

BACKGROUND

The present disclosure relates to a paper feed device which feeds sheets, an image forming apparatus and a method of controlling the paper feed device.

An image forming apparatus such as a multifunctional peripheral, a copying machine, a printer or a facsimile machine includes a paper feed device such as a sheet cassette. The paper feed device feeds out sheets which are set. The size of the sheets set in the paper feed device may be detected. In this way, it is possible to check whether or not the details of printing can be placed within the sheet. The following technology for the detection of a sheet size is known.

Specifically, a paper feed cassette device is known which includes detected means (cam group) that is provided in a cassette member, detecting means (contact type sensor) that is arranged in a cassette member fitting unit so as to be opposite the detected means, a guide frame member that is fitted to the cassette member so as to be freely moved and that guides the back edge or the side edge of stacked sheets and a coordination mechanism (a link mechanism and a transmission gear group) that is moved in a coordinated manner according to the movement of the guide frame member corresponding to the size of the stacked sheets and that moves the detected unit of the detected means away from or close to the detecting means, and which detects the size of the sheets stored in the cassette member.

The size and the remaining number of sheets which are set may be detected. For the detection, a plurality of optical sensors and a sensor such as a contact type switch are used. As the number of sensors is increased, the number of types of sheet sizes which can be detected is increased. As the number of types of sheet sizes which are detected is increased, the number of sensors which are installed is increased. In this case, the time and effort for development and the manufacturing cost are disadvantageously increased.

In order to specifically detect the remaining number of sheets, it is necessary to increase the number of sensors. However, the number of sensors installed is restricted physically and in terms of cost. At present, for example, the remaining number of sheets is detected in increments of about 25%. Hence, disadvantageously, it is impossible to accurately detect the remaining number of sheets.

In the known technology described above, a plurality of cams are used to detect the sheet size. However, the sheet sizes which can be detected are only standard sizes. The detected means and the coordination mechanism are needed. The configuration is complicated. Furthermore, in order to increase the number of sheet sizes which are detected, it is necessary to increase the number of cams. Hence, the known technology described above includes the same problem as described above. It is impossible to solve the problem described above.

SUMMARY

A paper feed device according to one aspect of the present disclosure includes a cursor, a cassette, a raising/lowering mechanism, a sensor unit, a storage unit and a control unit. The cursor makes contact with sheets which are set so as to regulate the position of the sheets. The cassette includes a lift plate in which the sheets are set on the upper surface and can be removed. The raising/lowering mechanism raises and lowers the lift plate. The sensor unit includes a coil substrate on which a coil pattern is printed. The sensor unit includes a conductive plate which is opposite the coil substrate without making contact therewith. The sensor unit applies a voltage to the coil substrate so as to generate a magnetic field and outputs an output value corresponding to the position of the conductive plate. The movement mechanism is moved in a coordinated manner with at least one of the cursor and the lift plate so as to move the conductive plate parallel to the flat surface of the coil substrate. The storage unit stores data for detecting the size of the sheets or the remaining number of the sheets. The control unit recognizes, based on the magnitude of the output value of the sensor unit, at least one of the size of the set sheets and the remaining number of the sheets.

Further features and advantages of the present disclosure will become apparent from the description of embodiments given below.

BRIEF DESCRIPTION OF THE DRAWINGS

FIG. 11 is a diagram showing an example of first sheet size data in the embodiment.

FIG. 12 is a diagram showing an example of second sheet size data in the embodiment.

DETAILED DESCRIPTION

In the present disclosure, it is possible to accurately perform detections on sheets without the provision of a large number of sensors. For example, it is possible to accurately detect the sheet size. It is not necessary to make a setting for a sheet size when the sheet of an irregular size is used. It is also possible to accurately detect the remaining number of sheets. It is possible to notify a user of the accurate remaining number of sheets.

An embodiment of the present disclosure will be described below with reference to FIGS. 1 to 22. In the following discussion, a description will be given using, as an example, a multifunctional peripheral 100 (which corresponds to an image forming apparatus) including a paper feed device 1. However, individual elements such as configurations and arrangements described in the embodiment do not limit the scope of the disclosure, and are simply examples of the description.

(Outline of Image Forming Apparatus)

Figure 1:
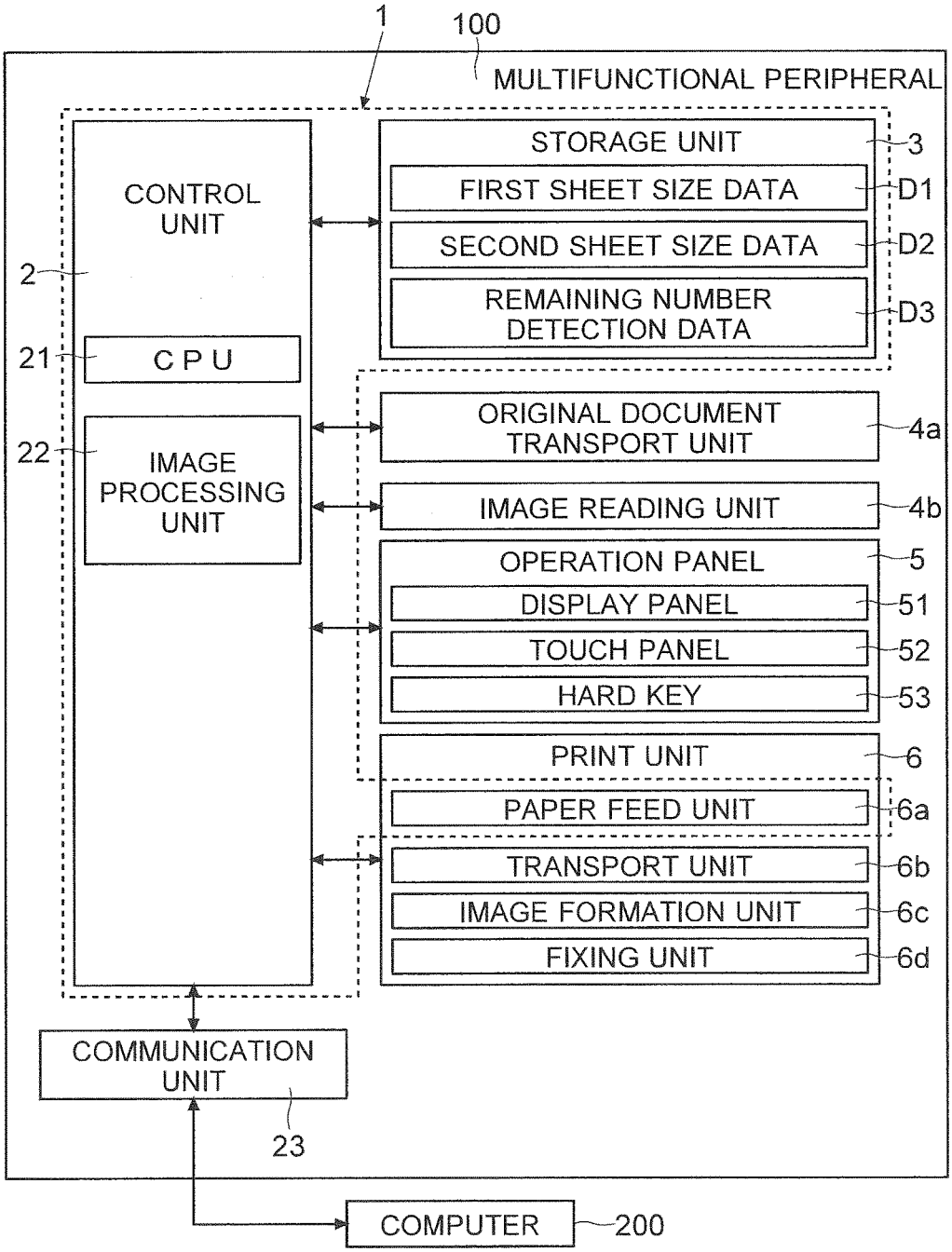
FIG. 1 is a diagram showing an example of a multifunctional peripheral according to an embodiment.

The multifunctional peripheral 100 according to the embodiment will first be described with reference to FIG. 1. The multifunctional peripheral 100 includes a control unit 2 and a storage unit 3. The control unit 2 supervises the operation of the entire apparatus. The control unit 2 controls the individual portions of the multifunctional peripheral 100. The control unit 2 includes a CPU 21 and an image processing unit 22. The CPU 21 performs computation and control. The image processing unit 22 performs image processing necessary for printing on image data. The storage unit 3 includes storage devices such as a ROM, a RAM and a HDD. The storage unit 3 stores programs for control and data.

The control unit 2 is connected to an original document transport unit 4*a* and an image reading unit 4*b* such that the control unit 2 can communicate with the original document transport unit 4*a* and the image reading unit 4*b*. The original document transport unit 4*a* transports an original document which is set toward a reading position. The image reading unit 4*b* reads the original document which is transported by the original document transport unit 4*a* and an original document which is set on an original document stage (contact glass, not shown). The image reading unit 4*b* generates image data on the original document. The control unit 2 controls the operations of the original document transport unit 4*a* and the image reading unit 4*b*.

The control unit 2 is connected to an operation panel 5 such that the control unit 2 can communicate with the operation panel 5. The operation panel 5 includes a display panel 51, a touch panel 52 and hard keys 53. Examples of the hard key 53 include a start key. The control unit 2 controls the display of the display panel 51. The control unit 2 displays information on the display panel 5. Examples of the information displayed include a setting screen, the state of the multifunctional peripheral 100 and a message. The control unit 2 displays operation images on the display panel 51. The operation images are, for example, a soft key and a button. The control unit 2 recognizes, based on the output of the touch panel 52, the operation image which is operated. The control unit 2 recognizes the hard key 43 which is operated. The control unit 2 makes the display panel 51 switch to a screen corresponding to the operation image or the hard key 53 which is operated. The control unit 2 controls the multifunctional peripheral 100 such that the multifunctional peripheral 100 is operated according to the setting on the operation panel 5.

The multifunctional peripheral 100 includes a print unit 6. The print unit 6 includes a paper feed unit 6*a*, a transport unit 6*b*, an image formation unit 6*c* and a fixing unit 6*d*. The control unit 2 controls the operations of the paper feed unit 6*a*, the transport unit 6*b*, the image formation unit 6*c* and the fixing unit 6*d*. Specifically, the control unit 2 controls printing-related processing. As the printing-related processing, the feeding of the sheet, the transport of the sheet and the formation, the transfer and the fixing of a toner image are present. Specifically, the control unit 2 makes the paper feed unit 6*a* supply the sheets one by one. The control unit 2 makes the transport unit 6*b* transport the supplied sheet to an ejection tray (not shown). The sheet is passed through the image formation unit 6*c* and the fixing unit 6*d*. The control unit 2 forms, on the image formation unit 6*c*, a toner image to be placed on the sheet transported with the transport unit 6*b*. The control unit 2 transfers the toner image to the sheet. The control unit 2 fixes the toner image transferred to the sheet to the fixing unit 5*c*.

The multifunctional peripheral 100 includes a communication unit 23. The communication unit 23 is an interface for communication. The communication unit 23 communicates with a computer 200. The computer 200 is, for example, a PC or a server. The communication unit 23 communicates with the computer 200 through a network. The communication unit 23 receives print data from the computer 200. The print data includes data which indicates the details of printing such as image data and print setting data. The control unit 2 makes the print unit 6 perform printing based on the print data.

(Paper Feed Unit 6*a*)

Figure 2:
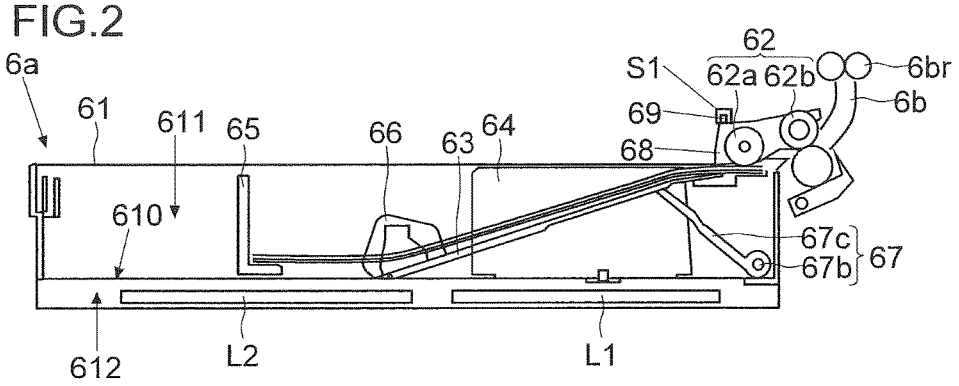
FIG. 2 is a diagram showing an example of a paper feed unit according to the embodiment.

The paper feed unit 6*a* according to the embodiment will then be described with reference to FIG. 2. The paper feed unit 6*a* stores a plurality of sheets. The paper feed unit 6*a* feeds out the sheets one by one. The paper feed unit 6*a* includes a cassette 61 and a paper feed mechanism 62. The cassette 61 can be removed from the multifunctional peripheral 100. The cassette 61 is removed, and then it is possible to supply sheets and change sheets to be set.

The cassette 61 includes a lift plate 63, a first cursor pair 64 (in FIG. 2, only one can be viewed) and a second cursor 65. On the lift plate 63, sheets (sheet bundle) are set. A support unit 66 supports the end portion of the lift plate 63 on the upstream side (the left-side end portion in FIG. 2) such that the end portion can be turned. The lift plate 63 can be turned in an up/down direction. The end portion of the lift plate 63 on the downstream side (the right-side end portion in FIG. 2) is a free end.

A raising/lowering mechanism 67 is provided below the end portion of the lift plate 63 on the downstream side. The raising/lowering mechanism 67 raises the lift plate 63. The raising/lowering mechanism 67 includes a raising motor 67*a* (see FIG. 3), a drive shaft 67*b* and a push-up member 67*c*. The push-up member 67*c* is formed in the shape of a plate. The push-up member 67*c* is attached to the drive shaft 67*b*. The drive shaft 67*b* is rotated by receiving the drive of the raising motor 67*a*. When the push-up member 67*c* is turned, the control unit 2 operates the raising motor 67*a*. Consequently, the drive shaft 67*b* is rotated. The tip end portion of the push-up member 67*c* is raised. The push-up member 67*c* is turned, and thus the end portion of the lift plate 63 on the downstream side is raised.

The first cursor pair 64 can be moved to slide in a direction perpendicular to a transport direction. The first cursors 64*a* of the first cursor pair 64 are moved in a coordinated manner. The first cursors 64*a* are brought into contact with the set sheets so as to regulate the position thereof. The second cursor 65 can be moved to slide along the transport direction. The second cursor 65 is brought into contact with the set sheets. The second cursor 65 regulates the position of the back end of the sheets.

The paper feed mechanism 62 includes a paper feed roller 62*a* and a separating roller pair 62*b*. The paper feed roller 62*a* is provided above the end portion of the lift plate 63 on the downstream side. The separating roller pair 62*b* is provided on the downstream side in the transport direction with respect to the paper feed roller 62*a*. The separating roller pair 62*b* is a roller pair for preventing stacked sheets from being fed. The roller on the upper side of the separating roller pair 62*b* is rotated in such a direction as to feed the sheet in a forward direction. The roller on the lower side is rotated in such a direction as to feed the sheet in a backward direction (the direction of the cassette 61).

(Paper Feed Device 1)

Figure 3:
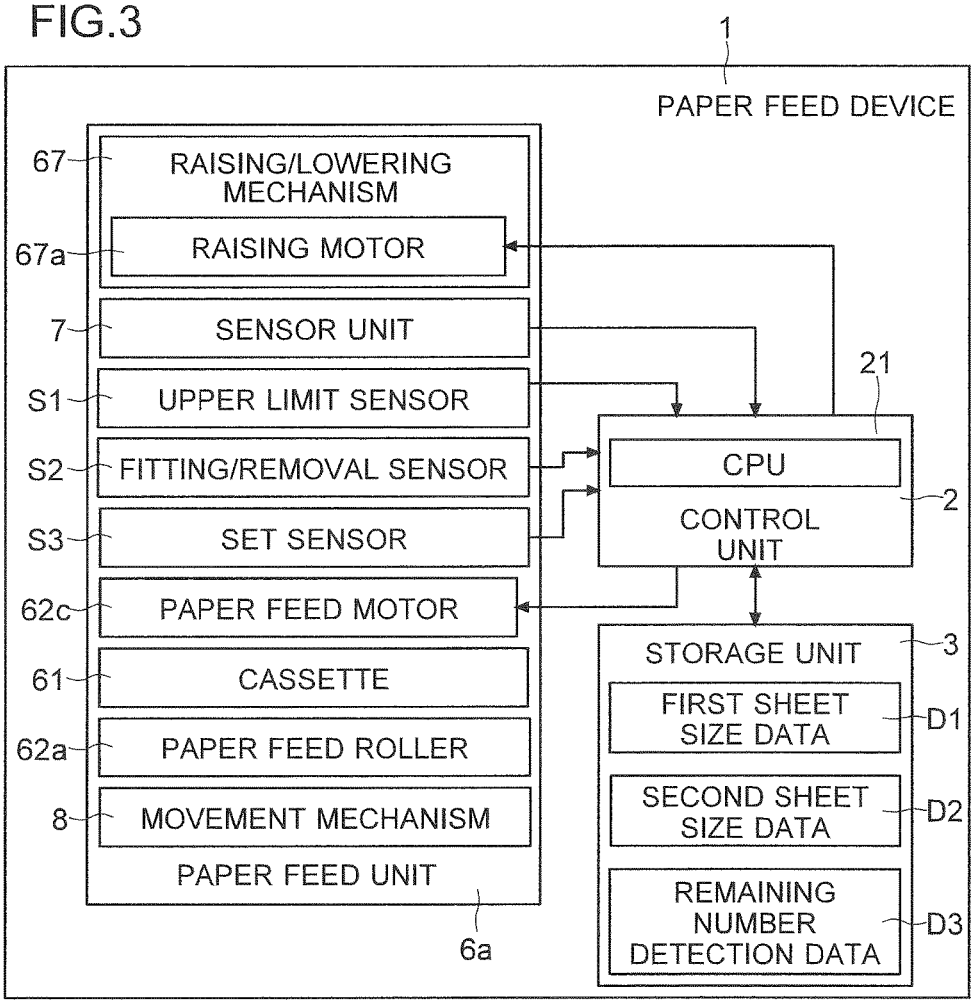
FIG. 3 is a diagram showing an example of a paper feed device according to the embodiment.
Figure 4:
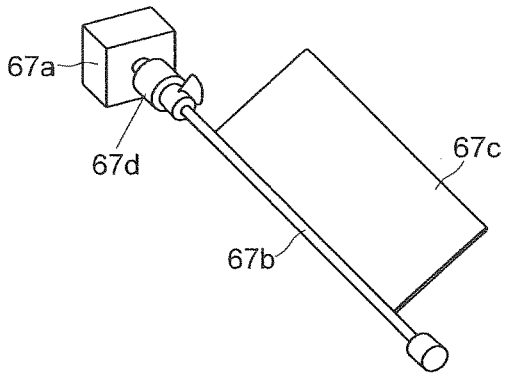
FIG. 4 is a diagram showing an example of a raising/lowering mechanism according to the embodiment.

The paper feed device 1 according to the embodiment will be described with reference to FIGS. 2 to 4. The paper feed device 1 includes the paper feed unit 6*a*, the control unit 2 and the storage unit 3. The paper feed unit 6*a* includes the cassette 61, the paper feed roller 62*a*, the raising/lowering mechanism 67, a sensor unit 7 and a movement mechanism 8. The details of the movement mechanism 8 will be described later. The paper feed unit 6*a* includes the sensor unit 7 therewithin. The sensor unit 7 is a portion for detecting the size of the sheets set in the paper feed unit 6*a* (the cassette 61). The sensor unit 7 is also a portion for detecting the remaining number of sheets set in the cassette 61 (on the lift plate 63). The details of the sensor unit 7 will be described later. The control unit 2 is also a portion for controlling the paper feed device 1. The storage unit 3 is also a portion for storing data on the paper feed device 1.

The paper feed roller 62*a* can be swung in the up/down direction. Specifically, the rotation shaft of the paper feed roller 62*a* is supported by a support shaft member 68. The support shaft member 68 is placed over the rotation shaft of the separating roller pair 62*b*. With the support shaft member 68, the paper feed roller 62*a* is swung in the up/down direction. The support shaft member 68 is swung in the up/down direction according to the vertical movement of the paper feed roller 62*a*. An upper limit sensor S1 is provided in the paper feed device 1. The upper limit sensor S1 detects that the paper feed roller 62*a* reaches a predetermined upper limit position by the lift plate 63.

As the end portion of the lift plate 63 on the downstream side is raised, the paper feed roller 62*a* and the uppermost sheet are brought into contact with each other. As the lift plate 63 is further raised, the position of the paper feed roller 62*a* is also raised. The upper limit sensor S1 detects the arrival of the paper feed roller 62*a* at the upper limit position. The lift plate 63 lifts up the paper feed roller 62*a*. Hence, the paper feed roller 62*a* is located in the upper limit position, and this means that the lift plate 63 is also located in the upper limit.

The upper limit sensor S1 is, for example, a transmission-type optical sensor. In the upper limit sensor S1, the output level (high level or low level) of a signal is changed depending on whether or not the paper feed roller 62*a* is in the upper limit position. A protrusion 69 is provided on the paper feed roller 62*a* or the support shaft member 68. When the paper feed roller 62*a* reaches the upper limit position, the protrusion 69 interrupts an optical path between the light emission portion and the light reception portion of the upper limit sensor S1 (optical sensor). Based on the output of the upper limit sensor S1, the control unit 2 recognizes that the paper feed roller 62*a* reaches the upper limit. When the control unit 2 recognizes that the paper feed roller 62*a* reaches the upper limit, the control unit 2 stops the raising motor 67*a*.

The details of the raising/lowering mechanism 67 will be described with reference to FIG. 4. The raising motor 67*a* of the raising/lowering mechanism 67 is provided outside the cassette 61 (on the side of the multifunctional peripheral 100). The longitudinal direction of the drive shaft 67*b* is parallel to the direction perpendicular to the sheet transport direction. The drive shaft 67*b* is coupled through a joint unit 67*d* to the raising motor 67*a*. The control unit 2 drives the raising motor 67*a*. Here, the raising motor 67*a* rotates the drive shaft 67*b* and the push-up member 67*c* attached thereto in such a direction as to raise the lift plate 63. The direction of the rotation of the joint unit 67*d* may be set to only the direction in which the push-up member 67*c* is raised.

When the cassette 61 is removed forward, the coupling of the raising motor 67*a* and the drive shaft 67*b* is disconnected by the action of the joint unit 67*d*. When the coupling is released by the removal of the cassette 61, the lift plate 63 is automatically lowered by the action of gravity. The raising/lowering mechanism 67 utilizes gravity so as to lower the lift plate 63. The lift plate 63 is finally lowered to the lower limit position (reference position). The raising/lowering mechanism 67 lowers the lift plate 63 and the push-up member 67*c* to the lower limit position. The lift plate 63 and the push-up member 67*c* fall down.

When the cassette 61 is returned, the raising motor 67*a* and the drive shaft 67*b* are coupled to each other with the joint unit 67*d*. Based on the output of a fitting/removal sensor S2, the control unit 2 recognizes that the cassette 61 is closed (returned). When the recognition is performed or when the feeding of the sheet is started, the control unit 2 drives the raising motor 67*a*. The control unit 2 raises the lift plate 63 to such a position that it is possible to feed the sheet (to the upper limit position of the paper feed roller 62*a*). Each time one or a plurality of sheets are fed, the control unit 2 temporarily rotates the raising motor 67*a*. The paper feed roller 62*a* which is slightly lowered by the consumption of the sheet is lifted up again to the upper limit position.

When the sheet is fed out, the control unit 2 rotates a paper feed motor 62*c*. In this way, the paper feed roller 62*a* and the separating roller pair 62*b* are rotated. The sheet is fed downstream with the paper feed roller 62*a* and the separating roller pair 62*b*. In the transport unit 6*b*, a plurality of transport roller pairs 6*br* are provided. The sheet is transported with the transport roller pairs 6*br* (see FIG. 2). In FIG. 2, for convenience, only one transport roller pair 6*br* is shown. When the printing is continuously performed on a plurality of sheets, the control unit 2 repeats the rotation and the temporary stop of the paper feed roller 62*a* such that a constant space between the sheets is formed.

In the paper feed unit 6*a*, a set sensor S3 is provided. The set sensor S3 is a sensor for detecting whether or not the sheet is set (for example, an optical sensor). The output level (high level or low level) of the signal of the set sensor S3 is changed depending on whether or not the set sheet is present. Based on the output of the set sensor S3, the control unit 2 can detect whether or not the sheet is set in the cassette 61. When the sheet is not present, the control unit 2 produces a display on the display panel 51 indicating that sheets run out.

In the paper feed unit 6*a*, the fitting/removal sensor S2 is provided. The fitting/removal sensor S2 is a sensor for detecting whether or not the cassette 61 is attached. The fitting/removal sensor S2 is, for example, an interlock switch. The output level (high level or low level) of the signal of the fitting/removal sensor S2 is changed according to whether the cassette 61 is attached or removed. Based on the output of the fitting/removal sensor S2, the control unit 2 can detect whether or not the cassette 61 is attached to the multifunctional peripheral 100.

(Sensor Unit 7)

Figure 5:
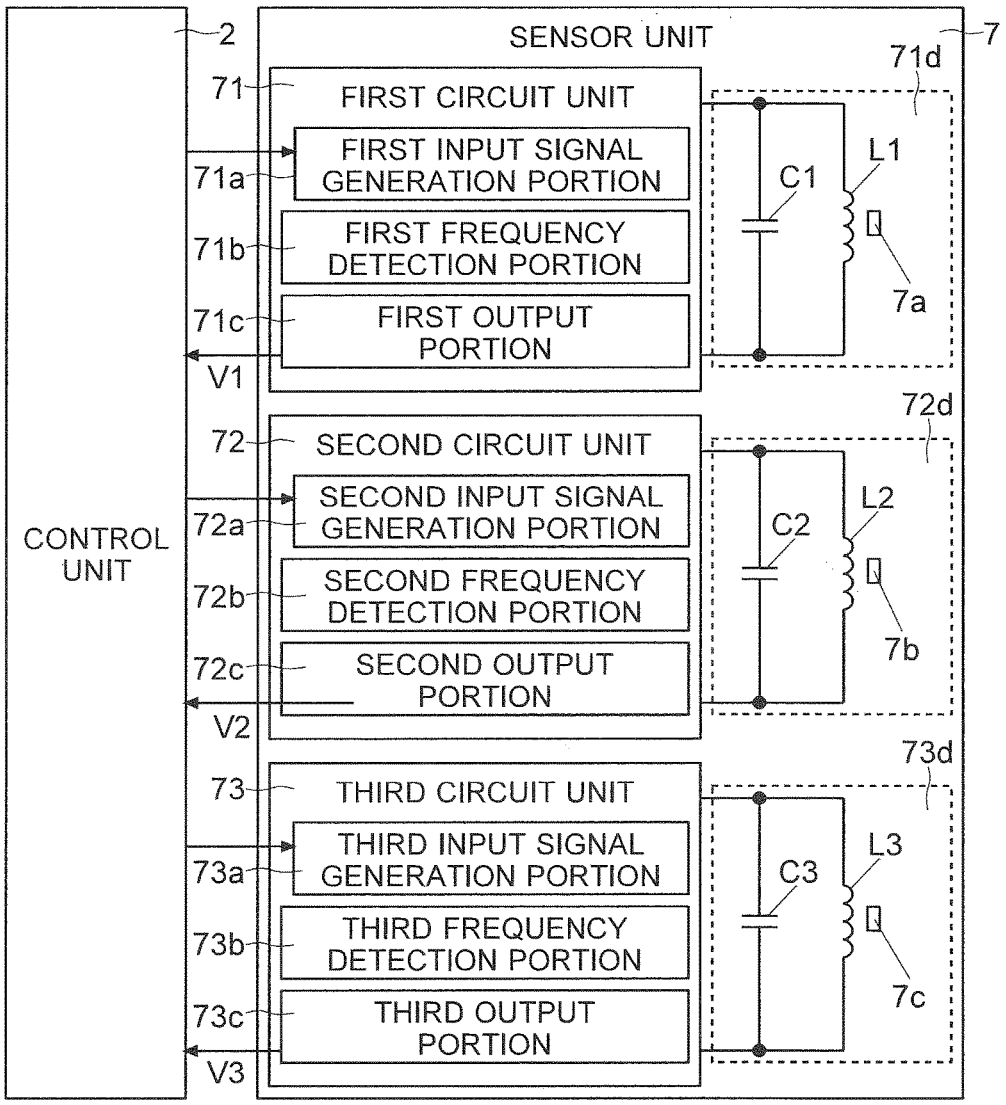
FIG. 5 is a diagram showing an example of a sensor unit according to the embodiment.

The sensor unit 7 included in the paper feed device 1 according to the embodiment will then be described with reference to FIG. 5. The sensor unit 7 includes a portion for detecting the size of the sheets set in the paper feed device 1 (the paper feed unit 6*a*). In order to detect the size in a direction perpendicular to the transport direction, the sensor unit 7 includes a first circuit unit 71, a first coil substrate L1, a first capacitor C1 and a first conductive plate 7*a*.

The first capacitor C1 has a predetermined capacitance. The first capacitor C1 and the first coil substrate L1 are connected parallel to the terminals of the first circuit unit 71. A first resonance circuit 71*d* includes the first coil substrate L1 and the first capacitor C1. The first coil substrate L1 is a substrate on which a coil pattern P1 is printed (the details of which will be described later). The first conductive plate 7*a* is a plate which has conductivity. As the first conductive plate 7*a*, a metallic plate such as a stainless steel plate or an aluminum plate can be used. The width of the first conductive plate 7*a* in a direction in which the first conductive plate 7*a* is moved is narrower than that of the first coil substrate L1 in a longitudinal direction (the details of the movement of the first conductive plate 7*a* will be described later).

The first conductive plate 7*a* is opposite the first coil substrate L1 without making contact therewith. The first conductive plate 7*a* is moved with a first cursor link mechanism 8*a* (the movement mechanism 8) in the longitudinal direction of the first coil substrate L1 (details of which will be described later). The inductance of the first coil substrate L1 is changed according to the position of the first conductive plate 7*a*. The resonance frequency of the first resonance circuit 71*d* is changed according to the position of the first conductive plate 7*a*.

The first circuit unit 71 includes a first input signal generation portion 71*a*, a first frequency detection portion 71*b* and a first output portion 71*c*. The first input signal generation portion 71*a* inputs a pulse signal to the first resonance circuit 71*d* (the first coil substrate L1). In this way, the first resonance circuit 71*d* resonates. The first frequency detection portion 71*b* counts the period of a signal waveform in the first resonance circuit 71*d*. The first frequency detection portion 71*b* detects the resonance frequency of the first resonance circuit 71*d*. The first output portion 71*c* outputs a first output value V1. The first output portion 71*c* sets a digital value corresponding to the resonance frequency (value obtained by counting the frequency) of the first resonance circuit 71*d* to the first output value V1. The first output value V1 is input to the control unit 2. The control unit 2 recognizes the magnitude of the first output value V1. As described above, the sensor unit 7 applies a voltage to the first coil substrate L1 so as to generate a magnetic field. The sensor unit 7 outputs the first output value V1 based on a resonance frequency corresponding to the position of the first conductive plate 7*a*.

In order to detect the size in a direction parallel to the transport direction, the sensor unit 7 includes a second circuit unit 72, a second coil substrate L2, a second capacitor C2 and a second conductive plate 7*b*.

The second capacitor C2 has a predetermined capacitance. The second capacitor C2 and the second coil substrate L2 are connected parallel to the terminals of the second circuit unit 72. A second resonance circuit 72*d* includes the second coil substrate L2 and the second capacitor C2. The second coil substrate L2 is a substrate on which a coil pattern P2 is printed (the details of which will be described later). The second conductive plate 7*b* is also a plate which has conductivity. As the second conductive plate 7*b*, a metallic plate such as a stainless steel plate or an aluminum plate can be used. The width of the second conductive plate 7*b* in a direction in which the second conductive plate 7*b* is moved is narrower than that of the second coil substrate L2 in the longitudinal direction (the details of the movement of the second conductive plate 7*b* will be described later).

The second conductive plate 7*b* is opposite the second coil substrate L2 without making contact therewith. The second conductive plate 7*b* is moved with a second cursor link mechanism 9 (the movement mechanism 8) in the longitudinal direction of the second coil substrate L2 (details of which will be described later). The inductance of the second coil substrate L2 is changed according to the position of the second conductive plate 7*b*. The resonance frequency of the second resonance circuit 72*d* is changed according to the position of the second conductive plate 7*b*.

The second circuit unit 72 includes a second input signal generation portion 72*a*, a second frequency detection portion 72*b* and a second output portion 72*c*. The second input signal generation portion 72*a* inputs a pulse signal to the second resonance circuit 72*d* (the second coil substrate L2). In this way, the second resonance circuit 72*d* resonates. The second frequency detection portion 72*b* counts the period of a signal waveform in the second resonance circuit 72*d*. The second frequency detection portion 72*b* detects the resonance frequency of the second resonance circuit 72*d*. A second output portion 72*c* outputs a second output value V2. The second output portion 72*c* sets a digital value corresponding to the resonance frequency (value obtained by counting the frequency) of the second resonance circuit 72*d* to the second output value V2. The second output value V2 is input to the control unit 2. The control unit 2 recognizes the magnitude of the second output value V2. The sensor unit 7 applies a voltage to the second coil substrate L2 so as to generate a magnetic field. The sensor unit 7 outputs the second output value V2 which corresponds to a resonance frequency corresponding to the position of the second conductive plate 7*b*.

The sensor unit 7 includes a part for detecting the remaining number of sheets set in the paper feed device 1 (the paper feed unit 6*a*). The sensor unit 7 includes a third circuit unit 73, a third coil substrate L3, a third capacitor C3 and a third conductive plate 7*c*.

The third capacitor C3 has a predetermined capacitance. The third capacitor C3 and the third coil substrate L3 are connected parallel to the terminals of the third circuit unit 72. A third resonance circuit 73*d* includes the third coil substrate L3 and the third capacitor C3. The third coil substrate L3 is a substrate on which a coil pattern P3 is printed (the details of which will be described later). The third conductive plate 7*c* is a plate which has conductivity.

As the third conductive plate 7*c*, a metallic plate such as a stainless steel plate or an aluminum plate can be used. The third conductive plate 7*c* is formed substantially in the shape of a triangle (shape like part of a crescent moon).

The third conductive plate 7*c* is opposite the third coil substrate L3 without making contact therewith. The third conductive plate 7*c* is moved by the movement mechanism 8 as the lift plate 63 is raised. As the third conductive plate 7*c* is moved, the area of the third conductive plate 7*c* opposite the third coil substrate L3 is changed. The magnitude of an eddy current which is generated in the third conductive plate 7*c* and the inductance of the third coil substrate L3 are changed according to the position of the third conductive plate 7*c*. Consequently, the resonance frequency of the third resonance circuit 73*d* is changed according to the position of the third conductive plate 7*c*.

The third circuit unit 73 includes a third input signal generation portion 73*a*, a third frequency detection portion 73*b* and a third output portion 73*c*. The third input signal generation portion 73*a* inputs a pulse signal to the third resonance circuit 73*d* (the third coil substrate L3), and thus the third resonance circuit 73*d* is made to resonate. The third frequency detection portion 73*b* counts the period of a signal waveform in the third resonance circuit 73*d*. The third frequency detection portion 73*b* detects the resonance frequency of the third resonance circuit 73*d*. A third output portion 73*c* outputs, as a third output value V3, a digital value corresponding to the resonance frequency (value obtained by counting the frequency) of the third resonance circuit 73*d*. The third output value V3 is input to the control unit 2. The control unit 2 recognizes the magnitude of the third output value V3. The sensor unit 7 applies a voltage to the third coil substrate L3 so as to generate a magnetic field. The sensor unit 7 outputs the third output value V3 corresponding to the position of the third conductive plate 7*c*.

(Outline of Detection of Sheet Side)

Figure 6:
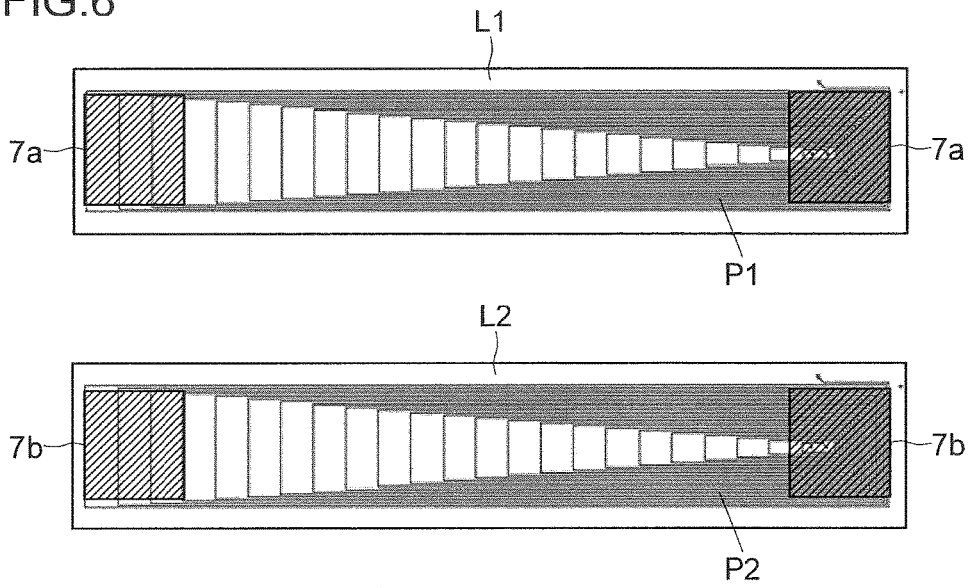
FIG. 6 is a diagram showing an example of a first coil substrate and a second coil substrate according to the embodiment.

The detection of a sheet size in the paper feed device 1 according to the embodiment will then be described with reference to FIGS. 6 and 7. The first coil substrate L1 is a substrate on which the coil pattern P1 is printed. The second coil substrate L2 is a substrate on which the coil pattern P2 is printed. As shown in FIG. 6, each of the coil pattern P1 and the coil pattern P2 is formed in the shape of a rectangular spiral. As shown in FIG. 6, the centers of the spirals of the coil pattern P1 and the coil pattern P2 are displaced in the direction of one ends of the coil substrates.

The length of the winding wire of the first coil substrate L1 in the longitudinal direction is decreased gradually (constantly) as the winding wire is extended inward. Specifically, as the number of windings is increased, the amount of extension of the winding wire in the longitudinal direction of the first coil substrate L1 is larger than the amount of extension of the winding wire in the lateral direction of the first coil substrate L1. For example, it is assumed that the length of the most inward winding wire in the longitudinal direction is n, and that the length of the winding wire in the longitudinal direction is the number of windings×n. On the other hand, the distance between the winding wires in the lateral direction is minimized (narrowed). The coil pattern P1 is formed such that the amount of winding wire opposite the first conductive plate 7*a* differs according to the position of the first conductive plate 7*a*.

The length of the winding wire of the second coil substrate L2 in the longitudinal direction is also decreased gradually (constantly) as the winding wire is extended inward. Specifically, as the number of windings is increased, the amount of extension of the winding wire in the longitudinal direction of the second coil substrate L2 is larger than the amount of extension of the winding wire in the lateral direction of the second coil substrate L2. For example, it is assumed that the length of the most inward winding wire in the longitudinal direction is n, and that the length of the winding wire in the longitudinal direction is the number of windings×n. On the other hand, the distance between the winding wires in the lateral direction is minimized (narrowed). The coil pattern P2 is formed such that the amount of winding wire opposite the second conductive plate 7*b* differs according to the position of the second conductive plate 7*b*.

The amount of winding wire opposite the first conductive plate 7*a* differs according to the position of the first conductive plate 7*a*. In other words, the density of the winding wire opposite the first conductive plate 7*a* differs according to the position of the first conductive plate 7*a*. In FIG. 6, the amount of winding wire opposite the first conductive plate 7*a* is increased as the first conductive plate 7*a* is located closer to the right side of the coil pattern P1.

The amount of eddy current which is generated in the first conductive plate 7*a* differs according to the position of the first conductive plate 7*a*. Hence, the magnitude of a magnetic force generated by the eddy current is changed according to the position of the first conductive plate 7*a*. The magnetic coupling strength between the magnetic field generated by the eddy current and the first coil substrate L1 is changed. Consequently, the inductance (impedance) of the first coil substrate L1 is changed according to the position of the first conductive plate 7*a*. Since the resonance frequency is changed, the output value of the first circuit unit 71 is changed according to the position of the first conductive plate 7*a*.

The amount of winding wire opposite the second conductive plate 7*b* differs according to the position of the second conductive plate 7*b*. The density of the winding wire opposite the second conductive plate 7*b* differs according to the position of the second conductive plate 7*b*. In FIG. 6, the amount of winding wire opposite the second conductive plate 7*b* is increased as the second conductive plate 7*b* is located closer to the right side of the coil pattern P2.

The amount of eddy current which is generated in the second conductive plate 7*b* differs according to the position of the second conductive plate 7*b*. The magnitude of a magnetic force generated by the eddy current is changed according to the position of the second conductive plate 7*b*. The magnetic coupling strength between the magnetic field generated by the eddy current and the second coil substrate L2 is changed. Consequently, the inductance (impedance) of the second coil substrate L2 is changed according to the position of the second conductive plate 7*b*. Since the resonance frequency is changed, the output value of the second circuit unit 72 is changed according to the position of the second conductive plate 7*b*.

Figure 7:
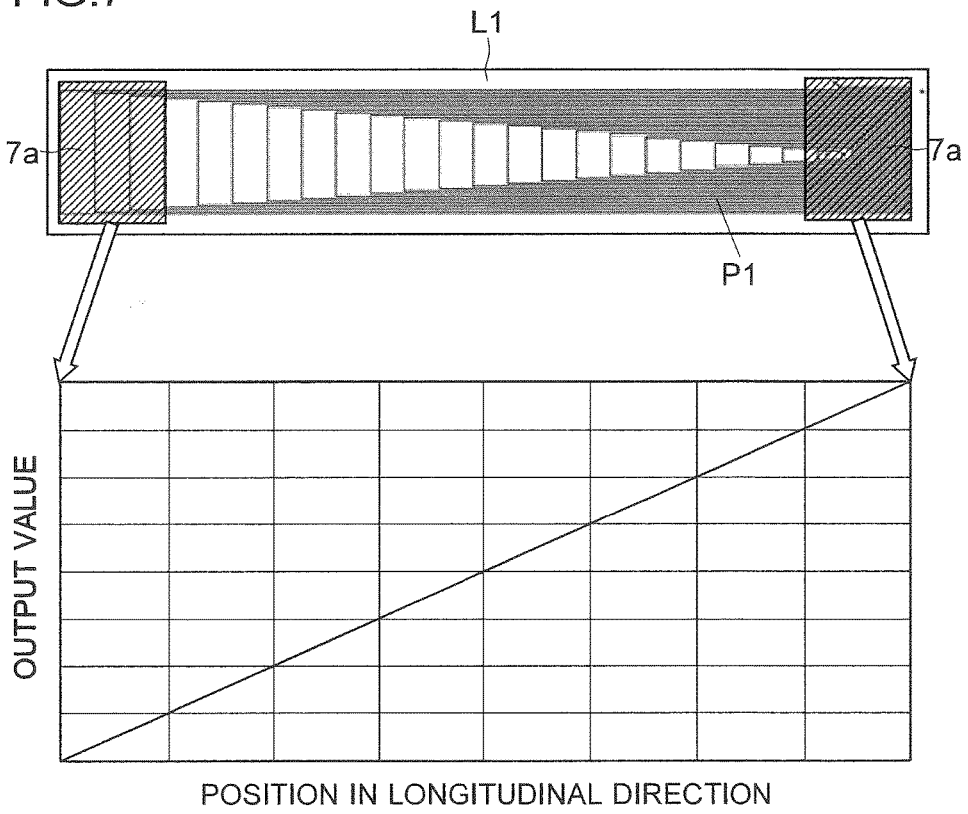
FIG. 7 is a diagram showing an example of the output value of the sensor unit corresponding to the position of a first conductive plate and a second conductive plate according to the embodiment.

FIG. 7 shows an example of the output of the first circuit unit 71. In FIG. 7, when the first conductive plate 7*a* is located on the left side, the first output value V1 (the resonance frequency) is decreased. As the position of the first conductive plate 7*a* is moved to the right side, the first output value V1 is increased. A state where the left end of the first conductive plate 7*a* is opposite the left end of the coil pattern P1 on the first coil substrate L1 so as to coincide therewith is assumed to be an initial state. FIG. 7 shows an example where the first output value V1 is increased in proportion to a movement distance from the initial position. A relationship between the position of the second conductive plate 7*b* and the second output value V2 (the resonance frequency) of the second circuit unit 72 is also a relationship as shown in FIG. 7 (the same as the first conductive plate 7*a*).

(First Cursor Link Mechanism 8*a*)

The first cursor link mechanism 8*a* of the paper feed device 1 according to the embodiment will then be described with reference to FIGS. 2 and 8. As shown in FIG. 2, the cassette 61 has a two-layer structure in which a partition plate 610 (bottom plate) is a boundary. In the inner side of an upper layer 611 (on the bottom plate), the lift plate 63 and the first cursor pair 64 are provided. In the inner side of a lower layer 612, the first cursor link mechanism 8*a* for detecting the size of the set sheets in the direction perpendicular to the transport direction, the first conductive plate 7*a* and the first coil substrate L1 are provided. In FIG. 2, for convenience, the first cursor link mechanism 8*a* and the first conductive plate 7*a* are not shown.

Figure 8:
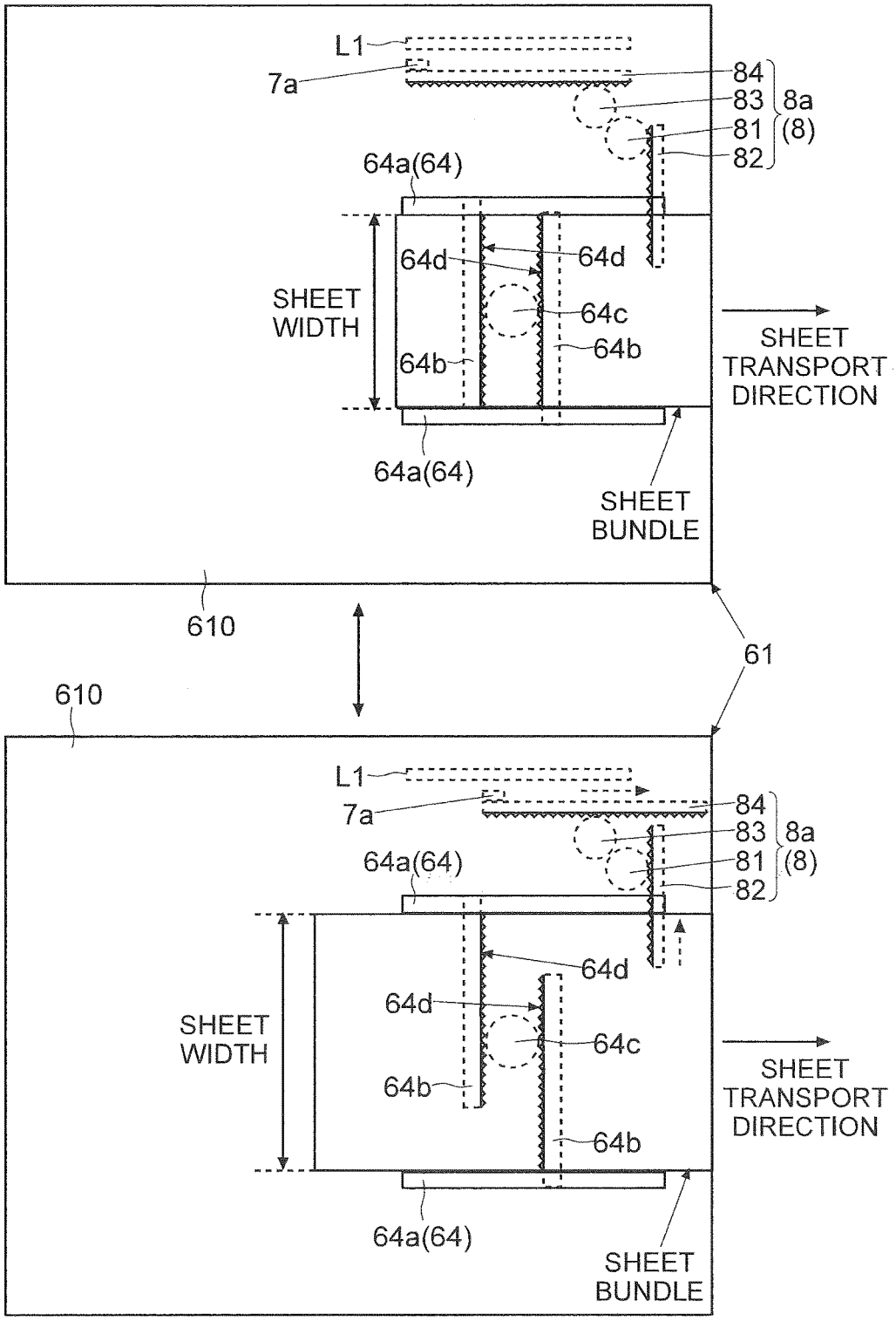
FIG. 8 is a diagram showing an example of a first cursor link mechanism according to the embodiment.

FIG. 8 is a diagram when the paper feed unit 6*a* (the paper feed device 1) is seen from above. In FIG. 8, members which are arranged in the lower layer 612 are indicated by broken lines. In FIG. 8, the lift plate 63 is not shown. The lower diagram of FIG. 8 shows a state where sheets which have a large size in the direction perpendicular to the transport direction as compared with the upper diagram are set.

As shown in FIG. 8, on the upper surface of the partition plate 610, the first cursor pair 64 is provided. The sheets are set on the upper surface of the partition plate 610. The first cursors 64*a* are parallel to the transport direction. Each of the first cursors 64*a* is a plate-shaped member which is provided to stand vertically with respect to the partition plate 610.

The first cursors 64*a* are moved to slide in the direction perpendicular to the transport direction. The inner surfaces of the first cursors 64*a* are brought into contact with the side surfaces (the edges in the width direction) of the sheets set in the cassette 61. The inner surfaces of the first cursors 64*a* are surfaces in which the first cursors 64*a* are opposite each other. The user moves the first cursor pair 64 according to the size (width) of the set sheets. In this way, the sheets are prevented from being moved. It is possible to regulate the position of the set sheets. It is also possible to feed out the sheet without the sheet being fed obliquely. As shown in FIG. 8, the position of the first cursors 64*a* (the distance between the first cursors 64*a*) is changed according to the size of the set sheets.

Coordination members 64*b* are attached to the lower sides of the first cursors 64*a* (the lower sides of the partition plate 610). The longitudinal direction of the coordination members 64*b* is set to the direction perpendicular to the transport direction. The coordination members 64*b* are members which are formed in the shape of a plate, a bar or a pillar. The coordination members 64*b* are attached vertically to the first cursors 64*a* when seen from the upper surface. The coordination members 64*b* are located in the lower layer 612. One of the coordination members 64*b* and the other coordination member 64*b* are displaced from each other in the transport direction.

A rotation member 64*c* is provided in a center position between the inner surfaces of the first cursors 64*a*. The rotation member 64*c* is provided between the coordination members 64*b* for the first cursors 64*a*. The rotation member 64*c* is also provided within the lower layer 612. The direction of the rotation shaft of the rotation member 64*c* is a direction which is perpendicular to the placement surface of the sheets (the partition plate 610). In the circumferential surface of the rotation member 64*c*, teeth are provided. In each of the coordination members 64*b*, a tooth surface 64*d* is provided. The tooth surface 64*d* is provided in the edge on the side of the rotation member 64*c* of the edges of each of the coordination members 64*b* in the direction perpendicular to the transport direction. The coordination members 64*b* are provided such that the tooth surfaces 64*d* engage with the tooth of the rotation member 64*c*.

The tooth surfaces 64*d* of the coordination members 64*b* engage with the tooth of the rotation member 64*c*. Hence, when one of the first cursor 64*a* is moved, the other first cursor 64*a* is also moved in a coordinated manner (moved). Specifically, when one of the first cursor 64*a* is moved inward, the other first cursor 64*a* is also moved inward. Moreover, when one of the first cursors 64*a* is moved outward, the other first cursor 64*a* is also moved outward. The first cursors 64*a* are moved in a coordinated manner, and thus even when the sheets of any size are set, the center of the sheets in the direction perpendicular to the transport direction coincides with the center of a sheet transport path in the width direction (sheet passing through the center).

The first coil substrate L1 is attached within the lower layer 612 of the cassette 61. The longitudinal direction of the first coil substrate L1 is set parallel to the transport direction. The first cursor link mechanism 8*a* is provided within the cassette 61. The first cursor link mechanism 8*a* is also provided within the lower layer 612 of the cassette 61. The first cursor link mechanism 8*a* moves, according to the position of the cursors, the first conductive plate 7*a* in the longitudinal direction of the first coil substrate L1.

The first cursor link mechanism 8*a* includes a first gear 81, a first rack 82, a second gear 83 and a second rack 84. The first rack 82 is connected to one of the first cursors 64*a*. The first rack 82 is attached to the first cursor 64*a*. The first rack 82 is attached such that the longitudinal direction is a direction which is perpendicular to the transport direction. The first rack 82 is moved in the direction perpendicular to the transport direction as the first cursor 64*a* is moved.

The tooth of the first rack 82 engage with the first gear 81. The first gear 81 engages with the second gear 83. The tooth of the second rack 84 engage with the second gear 83. The second rack 84 is opposite the first coil substrate L1. The second rack 84 is provided such that the longitudinal direction is a direction which is parallel to the transport direction. The second rack 84 is moved in the transport direction as the second gear 83 is rotated. Hence, the longitudinal direction and the movement direction of the second rack 84 are parallel to the longitudinal direction of the first coil substrate L1.

The first conductive plate 7*a* is attached to the second rack 84. As shown in FIG. 8, the first conductive plate 7*a* is attached to the surface of the second rack 84 which is opposite the first coil substrate L1. The first conductive plate 7*a* is also attached to an end portion of the second rack 84 on the upstream side in the transport direction. The first cursor link mechanism 8*a* (the first rack 82, the first gear 81, the second gear 83 and the second rack 84) converts the movement of the first cursor 64*a* in the direction perpendicular to the transport direction to the movement in the direction parallel to the transport direction. The first cursor link mechanism 8*a* moves, according to the position of the first cursor 64*a*, the first conductive plate 7*a* in the longitudinal direction of the first coil substrate L1. In this way, the amount of winding wire opposite the first conductive plate 7*a* is changed.

The lower diagram of FIG. 8 shows an example where the first conductive plate 7*a* is moved to the downstream side in the transport direction. The width of the first cursor pair 64 is increased, and thus the first rack 82 is moved upward. In this way, the first gear 81 and the second gear 83 are rotated. Then, the second rack 84 is moved to the downstream side in the transport direction.

The first conductive plate 7*a* is moved within a range from a position when sheets which can be used and which have the minimum size are set to a position when sheets which can be used and which have the maximum size are set. The range of the movement of the first conductive plate 7*a* is placed within an area between both ends of the coil pattern P1 on the first coil substrate L1 in the longitudinal direction. The gear ratio between the first gear 81 and the second gear 83 is adjusted such that the range of the movement is placed within the area between both the ends. Even when the sheets of any size are set, the first coil substrate L1 is opposite the first conductive plate 7*a*.

(Second Cursor Link Mechanism 9)

The second cursor link mechanism 9 of the paper feed device 1 according to the embodiment will then be described with reference to FIGS. 2 and 9. As shown in FIG. 2, in the inner side of the lower layer 612 of the cassette 61, the second cursor link mechanism 9, the second conductive plate 7*b* and the second coil substrate L2 are provided. The second cursor link mechanism 9 is a mechanism for detecting the size of the set sheets in the direction perpendicular to the transport direction. In FIG. 2, for convenience, the second cursor link mechanism 9 and the second conductive plate 7*b* are not shown.

Figure 9:
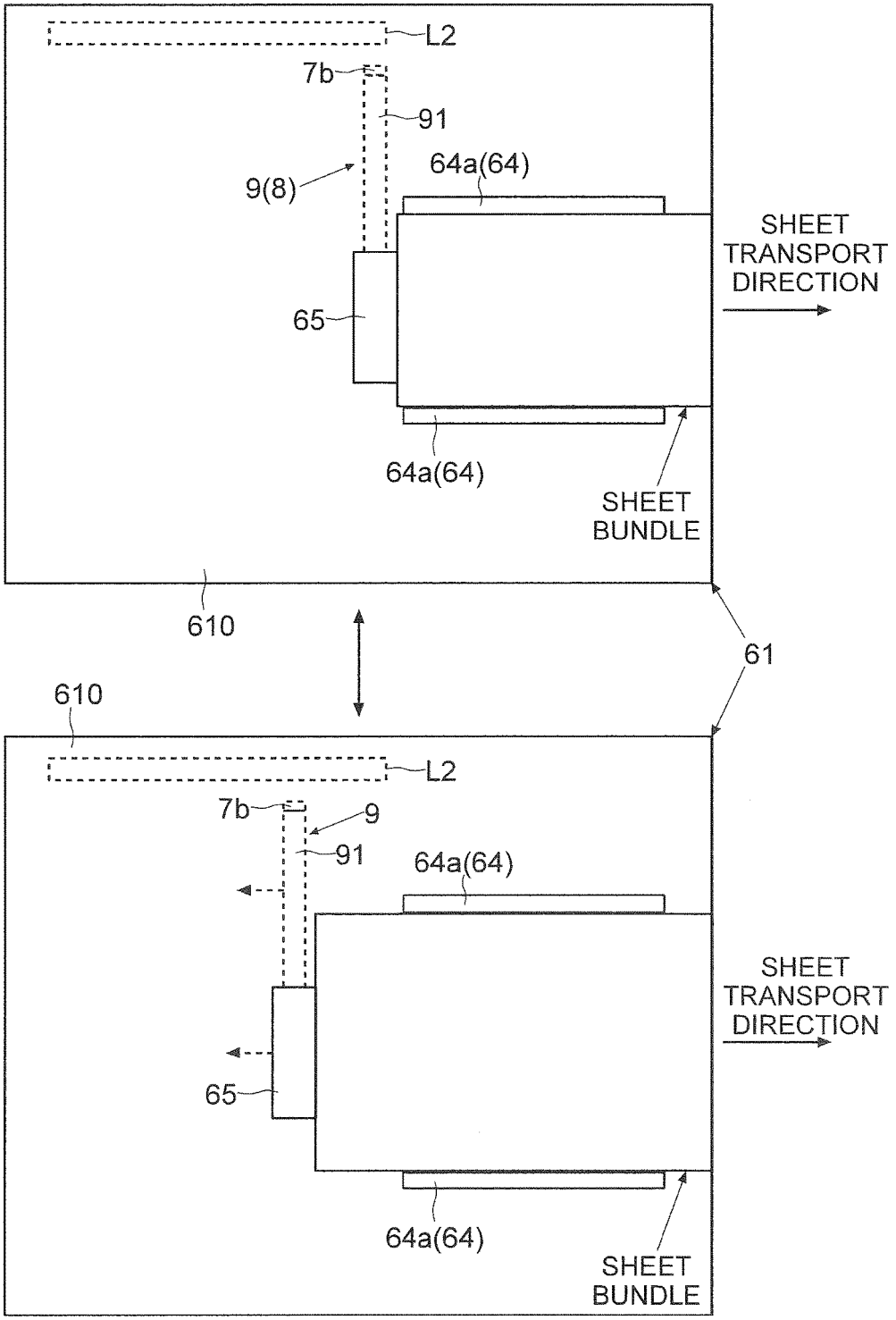
FIG. 9 is a diagram showing an example of a second cursor link mechanism according to the embodiment.

FIG. 9 is a diagram when the paper feed unit 6*a* (the paper feed device 1) is seen from above. In FIG. 9, members which are arranged in the lower layer 612 of the cassette 61 are indicated by broken lines. In FIG. 9, the lift plate 63 is not shown. The lower diagram of FIG. 9 shows a state where sheets which have a large size as compared with the upper diagram are set.

As shown in FIG. 9, the sheets are set on the upper surface of the partition plate 610. On the upper surface of the partition plate 610, the second cursor 65 is provided. The second cursor 65 regulates the position of the back end of the set sheets. The second cursor 65 is provided to stand in the direction perpendicular to the transport direction. The second cursor 65 is provided to stand vertically with respect to the partition plate 610.

The second cursor 65 is moved to slide in the direction parallel to the transport direction. The inner surface of the second cursor 65 is brought into contact with the back end of the set sheets (the edge on the upstream side in the transport direction). As shown in FIG. 9, the position of the second cursor 65 is changed according to the size of the set sheets. The user moves the second cursor 65 according to the size (width) of the set sheets. In this way, it is possible to regulate the position of the set sheets. Then, it is possible to align the positions of the tip ends and back ends of the sheets.

The second coil substrate L2 is attached within the lower layer 612 of the cassette 61. The longitudinal direction of the second coil substrate L2 is set parallel to the transport direction. The second cursor link mechanism 9 is provided within the cassette 61. The second cursor link mechanism 9 is provided within the lower layer 612 of the cassette 61. The second cursor link mechanism 9 moves, according to the position of the second cursor 65, the second conductive plate 7*b* in the longitudinal direction of the second coil substrate L2.

The second cursor link mechanism 9 includes a bar member 91. One end portion of the bar member 91 is connected (attached) to the second cursor 65. The longitudinal direction of the bar member 91 is set to the direction perpendicular to the transport direction. The other end portion of the bar member 91 is opposite the second coil substrate L2.

The second conductive plate 7*b* is attached to the other end of the bar member 91. The second cursor link mechanism 9 moves the bar member 91 according to the position of the second cursor 65. The second conductive plate 7*b* is moved in the longitudinal direction of the second coil substrate L2. In this way, the amount of winding wire opposite the second conductive plate 7*b* is changed.

The lower diagram of FIG. 9 shows an example where the position of the second conductive plate 7*b* is moved to the upstream side in the transport direction. As the second cursor 65 is moved to the upstream side in the transport direction, the bar member 91 is moved in a coordinated manner. The second conductive plate 7*b* is moved within a range from a position when sheets which can be used and which have the minimum size are set to a position when sheets which can be used and which have the maximum size are set. The range of the movement of the second conductive plate 7*b* is placed within an area between both ends of the coil pattern P2 on the second coil substrate L2 in the longitudinal direction. The length of the second conductive plate 7*b* is set longer than the range of the movement. Even when the sheets of any size are set, the second coil substrate L2 is opposite the second conductive plate 7*b*.

(Flow of Detection of Sheet Size)

An example of the flow of the detection of a sheet size in the paper feed device 1 according to the embodiment will then be described with reference to FIGS. 10 to 12. In the paper feed device 1 of the multifunctional peripheral 100, when conditions for performing the detection of a predetermined size are satisfied, the width of the set sheets is detected.

The performance conditions can be determined as necessary. For example, the turning on of the power supply of the multifunctional peripheral 100, the cancellation of the power saving mode in the multifunctional peripheral 100 (the restart of the supply of power to the paper feed unit 6*a* and the sensor unit 7), the fitting and removal of the cassette 61, the start of a print job (paper feed from the paper feed unit 6*a*) or the input of an instruction to perform the detection of the sheet size to the operation panel 5 can be set to the performance conditions.

Figure 10:
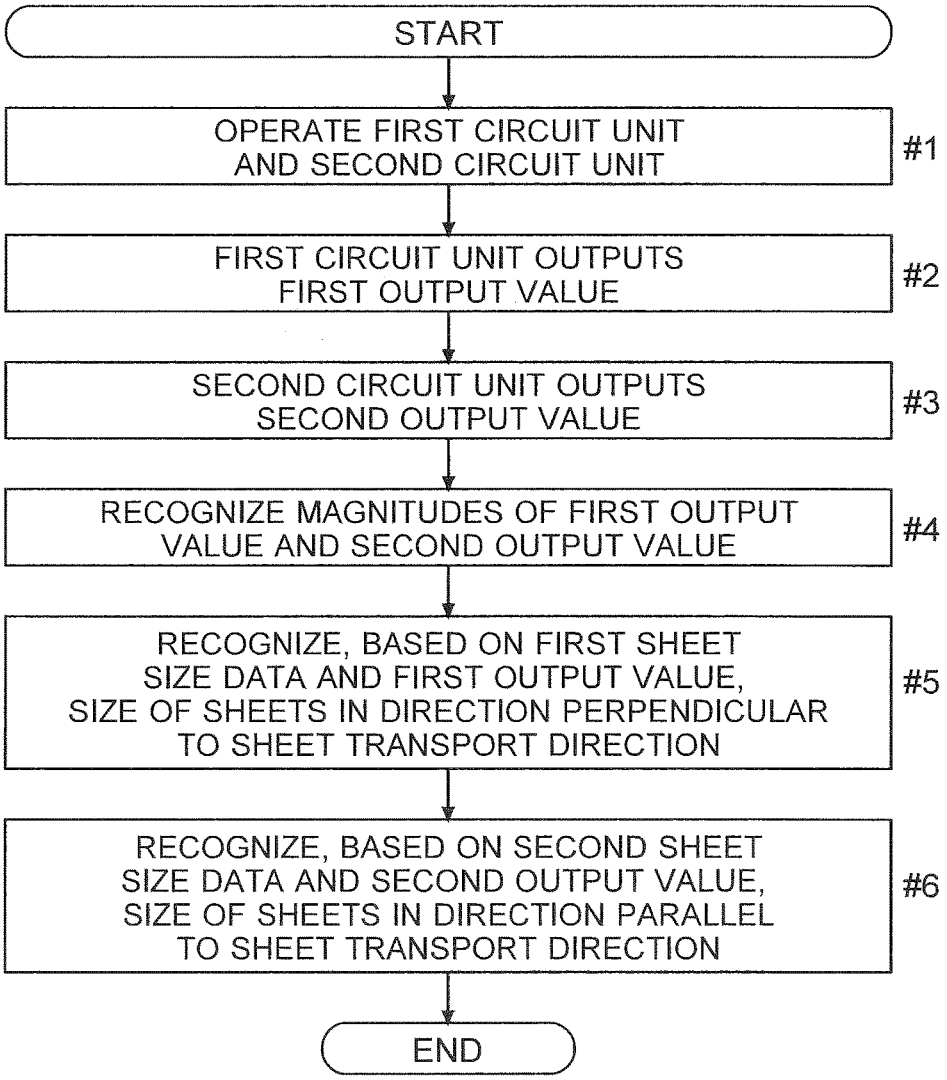
FIG. 10 is a diagram showing an example of the flow of the detection of a sheet size in the embodiment.

The start of FIG. 10 is the time when the performance conditions for the detection of the size are satisfied. The control unit 2 first operates the first circuit unit 71 and the second circuit unit 72 (step #1). In this way, the first circuit unit 71 outputs the first output value V1 corresponding to the resonance frequency of the resonance circuit (step #2). The second circuit unit 72 outputs the second output value V2 corresponding to the resonance frequency of the resonance circuit (step #3).

The control unit 2 recognizes the magnitudes of the first output value V1 and the second output value V2 (step #4). Based on first sheet size data D1 (stored in the storage unit 3) and the first output value V1, the control unit 2 recognizes the size of the set sheets in the direction perpendicular to the transport direction (step #5).

Here, the first sheet size data D1 will be described with reference to FIG. 11. The magnitude of the first output value V1 is the value which corresponds to the position of the first conductive plate 7*a* (the position of the first cursor pair 64). As shown in FIG. 11, the first sheet size data D1 can be set to table data in which the size of the sheet for the first output value V1 is defined.

The accuracy of the sensor unit 7 (the first output portion 71*c*) is so high as to have a resolution of about 16 to 24 bits. For example, the range of the first output value V1 can be determined in increments of 1 mm in the sheet (may be determined in increments of 0.1 mm). In this way, the control unit 2 can detect (recognize) the size of the sheet more specifically than conventional methods. The first conductive plate 7*a* and the first coil substrate L1 are not brought into contact with each other. Hence, there is little age deterioration.

As described with reference to FIG. 7, the amount of change (inclination) in the first output value V1 with respect to the amount of movement of the first conductive plate 7*a* is constant. The first output value V1 linearly changes with the amount of movement of the first conductive plate 7*a*. Hence, the first sheet size data D1 may be set to a linear function of Z (sheet size)=a (inclination)×X (first output value V1)+b (intercept). In this case, the control unit 2 performs a computation with the linear function so as to determine the sheet size.

Based on second sheet size data D2 (stored in the storage unit 3) and the second output value V2, the control unit 2 recognizes the size of the set sheets in the direction parallel to the transport direction (step #6). In step #6, the detection of the size of the set sheet is completed. Then, the present flow is completed (end).

Here, the second sheet size data D2 will be described with reference to FIG. 12. The magnitude of the second output value V2 is the value which corresponds to the position of the second conductive plate 7*b* (the position of the second cursor 65). As shown in FIG. 12, the second sheet size data D2 can be set to table data in which the size of the sheet for the second output value V2 is defined.

The second output portion 72*c* of the sensor unit 7 also has a resolution of about 16 to 24 bits. Hence, for example, the range of the second output value V2 can be determined in increments of 1 mm in the sheet (may be determined in increments of 0.1 mm). In this way, the control unit 2 can detect (recognize) the size of the sheet in the transport direction more specifically than the conventional methods. The second conductive plate 7*b* and the second coil substrate L2 are not brought into contact with each other. Hence, there is little age deterioration.

As described with reference to FIG. 7, the amount of change (inclination) in the second output value V2 with respect to the amount of movement of the second conductive plate 7*b* is also constant. The second output value V2 linearly changes with the amount of movement of the second conductive plate 7*b*. Hence, the second sheet size data D2 may be set to a linear function of Z (sheet size)=a (inclination)×Y (second output value V2)+b (intercept). In this case, the control unit 2 performs a computation with the linear function so as to determine the sheet size in the transport direction.

(Variation)

Figure 13:
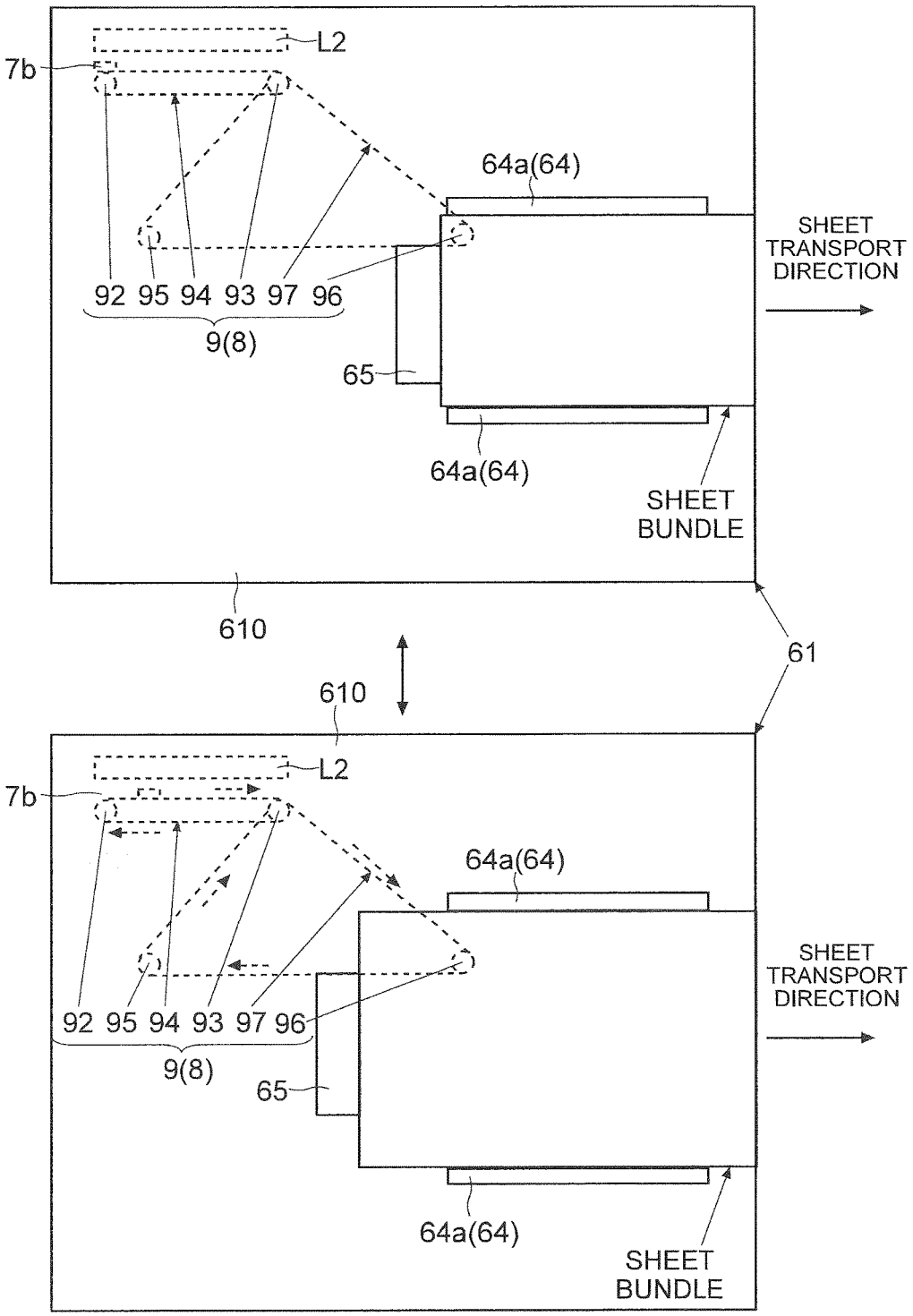
FIG. 13 is a diagram showing an example of a paper feed device according to a variation.

A variation of the second cursor link mechanism 9 will then be described with reference to FIG. 13. The configurations other than the second cursor link mechanism 9 are the same as in the embodiment described above. Even in the variation, the second coil substrate L2 is attached such that the longitudinal direction is parallel to the transport direction. In the variation, the bar member 91 is omitted. Instead, the second cursor link mechanism 9 includes a first pulley 92, a second pulley 93, a first belt 94, a third pulley 95, a fourth pulley 96 and a second belt 97.

The first belt 94 is placed over the first pulley 92 and the second pulley 93. The first pulley 92 is opposite the end portion of the second coil substrate L2 on the upstream side in the transport direction. The second pulley 93 is opposite the end portion of the second coil substrate L2 on the downstream side in the transport direction. The second conductive plate 7*b* is stuck to the outer circumferential surface of the first belt 94. The second conductive plate 7*b* is opposite the second coil substrate L2.

The second belt 97 is placed over the third pulley 95 and the fourth pulley 96. The second belt 97 is also placed over any one of the first pulley 92 and the second pulley 93. FIG. 13 shows an example where the second belt 97 is placed over the second pulley 93. The third pulley 95 and the fourth pulley 96 are aligned in the direction parallel to the transport direction. In this way, the second belt 97 is strung such that part of the second belt 97 is parallel to the transport direction. The part of the second belt 97 which is parallel to the transport direction is connected to one end (one part) of the second cursor 65. FIG. 13 shows an example where when the second cursor 65 is moved to the upstream side in the transport direction, the second belt 97 is rotated clockwise. When the second cursor 65 is moved to the downstream side in the transport direction, the second belt 97 is rotated counterclockwise according to the movement of the second cursor 65.

The second belt 97 is placed over any one of the first pulley 92 and the second pulley 93. Hence, when the second belt 97 is rotated, the first belt 94 is also rotated. When the second cursor 65 is moved to the upstream side in the transport direction, the second belt 97 is rotated clockwise (the movement from the upper diagram of FIG. 13 to the lower diagram). The second conductive plate 7*b* is moved to the downstream side in the transport direction. In a coordinated manner with the movement of the second cursor 65, the first belt 94 and the second belt 97 are rotated. Consequently, in the longitudinal direction of the second coil substrate L2, the second conductive plate 7*b* can be moved.

Here, the pulley (in the example of FIG. 13, the second pulley 93) over which both the first belt 94 and the second belt 97 are placed will be described. The diameter of the part over which the first belt 94 is placed is smaller than that of the part over which the second belt 97 is placed. In this way, the amount of movement of the first belt 94 is equal to the value which is obtained by multiplying the amount of movement of the second belt 97 by a ratio between the diameters (diameter of the part over which the first belt 94 is placed/diameter of part over which the second belt 97 is placed). This ratio is equal to or less than 1. The amount of movement of the first belt 94 is smaller than the amount of movement of the second belt 97. In this way, it is possible to reduce the size of the second coil substrate L2.

Even in the variation, the range of the movement of the second conductive plate 7*b* is from the position when sheets which can be used and which have the minimum size are set to the position when sheets which can be used and which have the maximum size are set. The length of the second conductive plate 7*b* and the diameter of the pulley over which the first belt 94 is placed are set such that the range of the movement of the second conductive plate 7*b* is placed within an area between both ends of the coil pattern P2 on the second coil substrate L2 in the longitudinal direction. Even when the sheets of any size are set, the second coil substrate L2 is opposite the second conductive plate 7*b*.

(Outline of Detection of the Remaining Number of Sheets)

Figure 14:
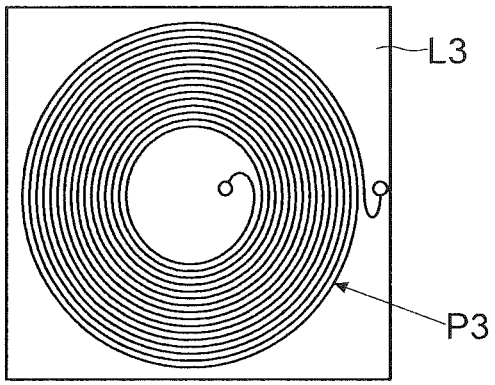
FIG. 14 is a diagram showing an example of a third coil substrate according to the embodiment.

The detection of the remaining number of sheets in the paper feed device 1 according to the embodiment will then be described with reference to FIGS. 14 to 16. The third coil substrate L3 is a substrate on which the coil pattern P3 is printed. As shown in FIG. 14, the coil pattern P3 of the third coil substrate L3 is formed in the shape of a circular spiral. The third coil substrate L3 may be formed by stacking a plurality of coil patterns P3 in layers.

Figure 15:
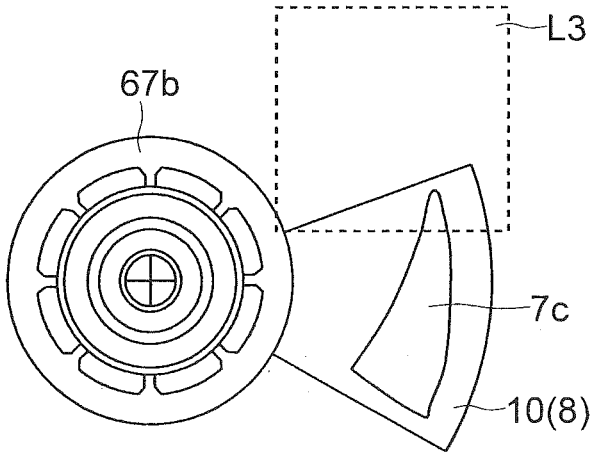
FIG. 15 is a diagram showing an example of a movement mechanism according to the embodiment.

As shown in FIG. 15, a fan-shaped rotation plate 10 is attached to the drive shaft 67*b* as the movement mechanism 8. The rotation angle of the rotation plate 10 is changed according to the rotation angle of the drive shaft 67*b*. The third conductive plate 7*c* is attached to the rotation plate 10. The third coil substrate L3 is opposite the rotation plate 10. The third conductive plate 7*c* is attached to the rotation plate 10 such that the most acute part of the third conductive plate 7*c* (the tip end portion of a crescent moon) is the upper side. FIG. 15 shows an example of the position to which the third coil substrate L3 is attached, which is indicated by broken lines and which is seen in a horizontal direction. The distance of the third coil substrate L3 and the third conductive plate 7*c* in the horizontal direction (the interval between the surface of the third coil substrate L3 and the surface of the third conductive plate 7*c*) is about a few millimeters to 5 millimeters.

The drive shaft 67*b* is rotated, and thus the area of the third coil substrate L3 opposite the third conductive plate 7*c* is changed. FIG. 15 shows an example of the position of the third conductive plate 7*c* when the sheets are fully set. In FIG. 15, the area of the third coil substrate L3 opposite the third conductive plate 7*c* is relatively small. As the sheets are consumed, the drive shaft 67*b* is rotated. The third conductive plate 7*c* (the lift plate 63) is raised in the upward direction (the direction of the third coil substrate L3). The third conductive plate 7*c* is moved closer to the center of the third coil substrate L3. In this way, the area of the third coil substrate L3 opposite the third conductive plate 7*c* is increased.

The amount of winding wire of the coil pattern P3 opposite the third conductive plate 7*c* is changed according to the position of the third conductive plate 7*c* (the height of the lift plate 63). As shown in FIG. 16, as the lift plate 63 is raised, the amount of winding wire of the coil opposite the third conductive plate 7*c* is increased. In other words, as the lift plate 63 is raised, the area of the third conductive plate 7*c* opposite the third coil substrate L3 is increased.

The amount of eddy current generated in the third conductive plate 7*c* is changed according to the position of the third conductive plate 7*c*. The magnitude of a magnetic force generated by the eddy current is changed according to the position of the third conductive plate 7*c*. The magnetic coupling strength between the third coil substrate L3 and the third conductive plate 7*c* is also changed. The inductance (impedance) of the third coil substrate L3 is also changed. Consequently, the third output value V3 of the third circuit unit 73 is the value which corresponds to the position of the third conductive plate 7*c*.

Figure 16:
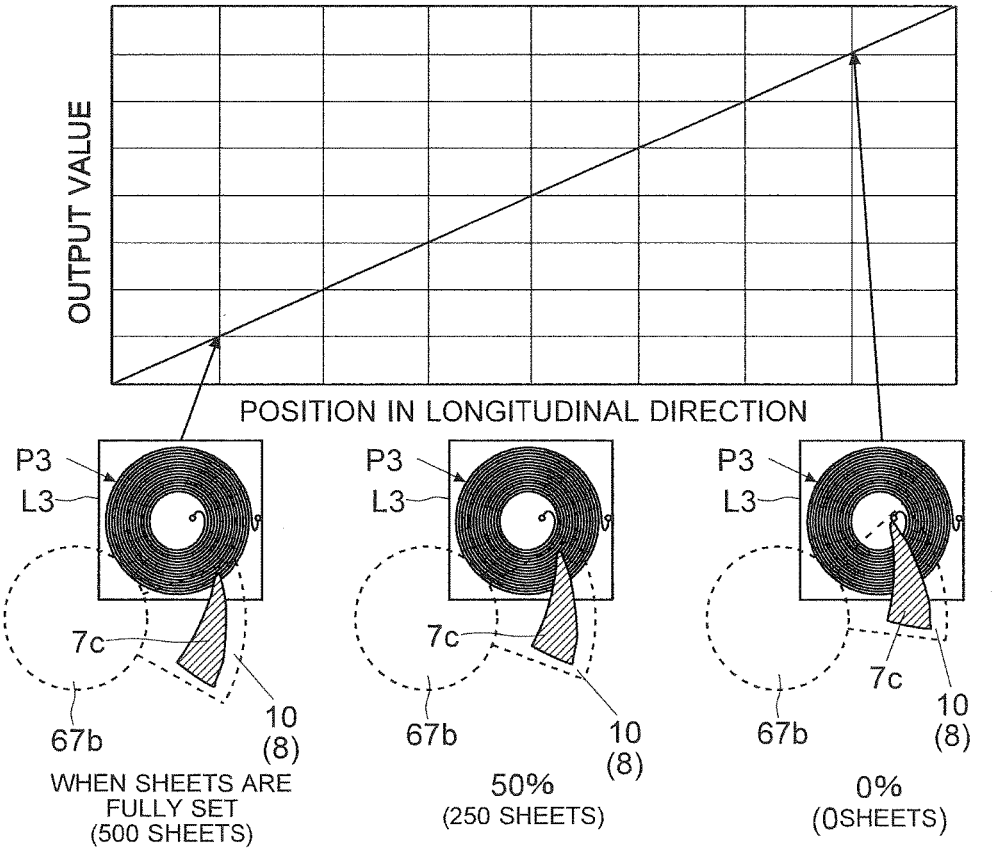
FIG. 16 is a diagram showing a third output value of the sensor unit according to the embodiment.

FIG. 16 shows an example of the output of the third circuit unit 73. In the paper feed device 1, as a larger number of sheets are present within the cassette 61 (as the sheet bundle is thicker, as the lift plate 63 is lowered or as the distance between the lift plate 63 and the paper feed roller 62*a* is increased), the third output value V3 is decreased. As a smaller number of sheets are present within the cassette 61 (as the sheet bundle is thinner, as the lift plate 63 is raised or as the distance between the lift plate 63 and the paper feed roller 62*a* is decreased), the third output value V3 is increased. The third conductive plate 7*c* is formed substantially in the shape of a triangle. In this way, the third output value V3 is changed proportionally to the change in the remaining number of sheets (the height of the lift plate 63). In other words, the ratio between the amount of change in the height of the lift plate 63 (the remaining number of sheets) and the amount of change in the third output value V3 is constant.

(Flow of Detection of the Remaining Number of Sheets)

Figure 19:
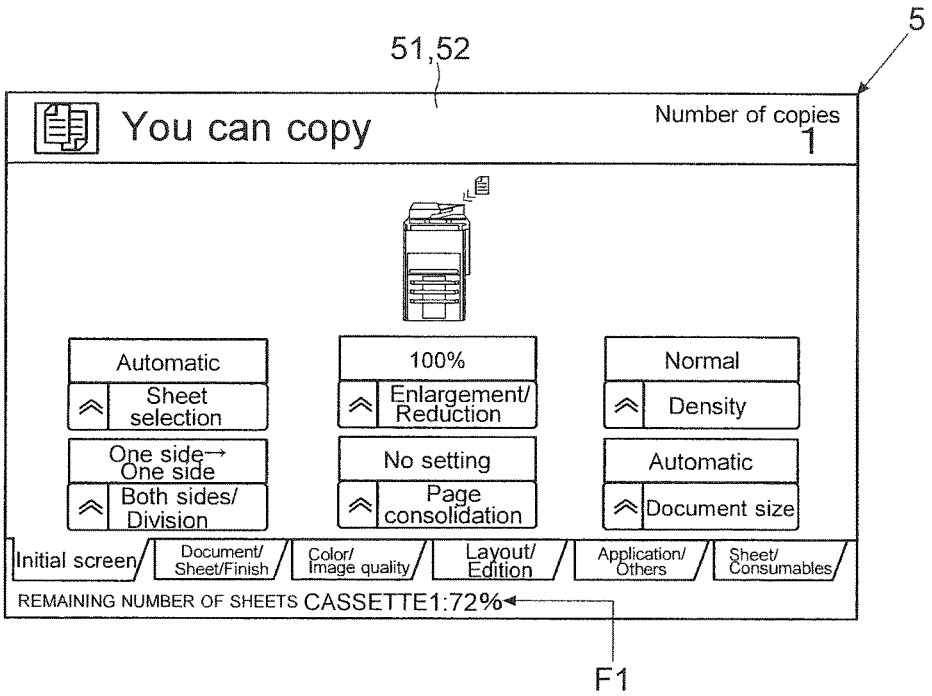
FIG. 19 is a diagram showing an example of a remaining number message in the embodiment.

An example of the flow of the detection of the remaining number of sheets in the embodiment will then be described with reference to FIGS. 17 to 19. In the paper feed device 1 of the multifunctional peripheral 100, when predetermined conditions for performing the detection of the remaining number of sheets are satisfied, the remaining number of sheets is detected. The performance conditions can be determined as necessary. The turning on of the power supply of the multifunctional peripheral 100, the cancellation of the power saving mode (the restart of the supply of power to the paper feed unit 6*a* and the sensor unit 7), the fitting and removal of the cassette 61, the start of a print job (paper feed from the paper feed unit 6*a*), the completion of the feeding of the last sheet in the job or the input of an instruction to perform the detection of the remaining number of sheets to the operation panel 5 can be set to the performance conditions.

Figures 17, 18:
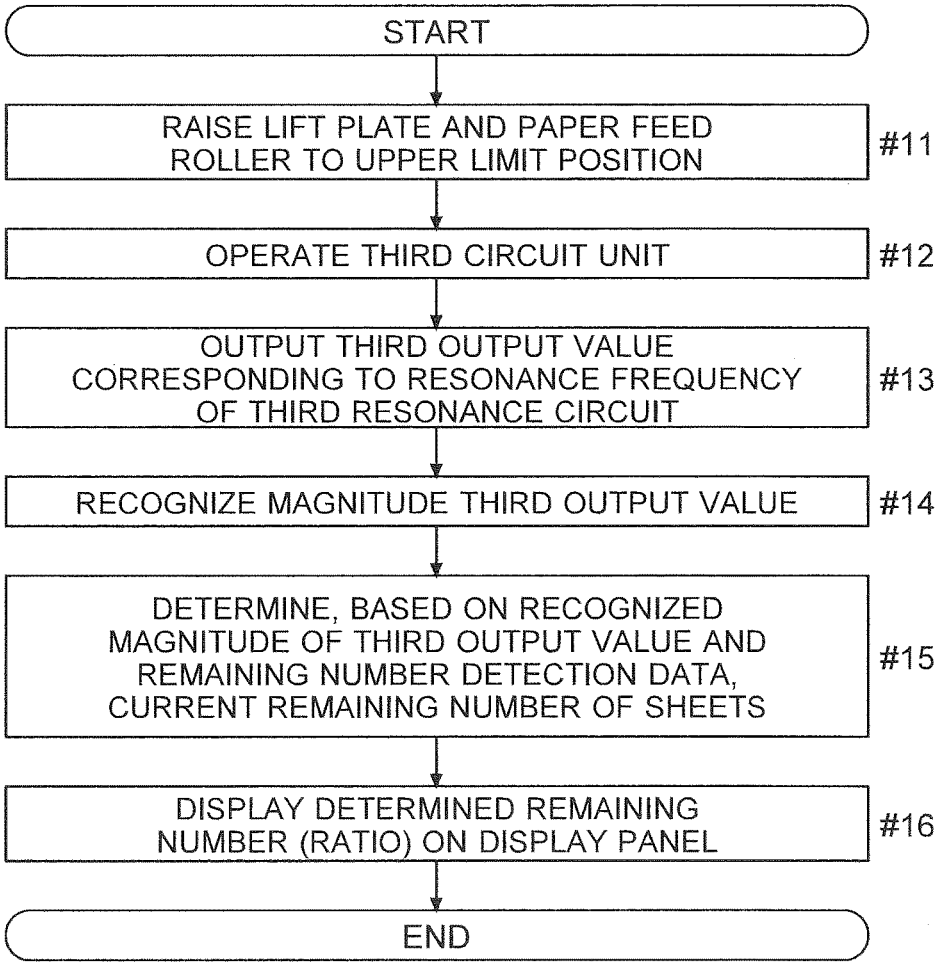
FIG. 17 is a flowchart showing an example of the flow of the detection of the remaining number of sheets in the embodiment.
FIG. 18 is a diagram showing an example of remaining number detection data in the embodiment.

The start of FIG. 17 is the time when the performance conditions for the detection of the remaining number are satisfied. The control unit 2 raises the paper feed roller 62*a* (the lift plate 63) to the upper limit position (step #11). Here, the control unit 2 operates the raising motor 67*a*. When it can be recognized based on the output of the upper limit sensor S1 at the time of the start of step #11 that the paper feed roller 62*a* is in the upper limit position, step #11 may be omitted.

The control unit 2 operates the third circuit unit 73 (step #12). In this way, the third resonance circuit 73*d* resonates. The third circuit unit 73 outputs the third output value V3 corresponding to the resonance frequency of the third resonance circuit 73*d* (according to the remaining number of sheets or according to the thickness of the sheet bundle set) (step #13).

The control unit 2 recognizes the magnitude of the third output value V3 (step #14). Based on remaining number detection data D3 (stored in the storage unit 3) and the third output value V3, the control unit 2 determines the remaining number of set sheets (step #15). The remaining number detection data D3 is stored in the storage unit 3 in a nonvolatile manner. The remaining number detection data D3 is data for determining the current remaining number of sheets corresponding to the third output value V3.

The remaining number detection data D3 will be described with reference to FIG. 18. As described above, the magnitude of the third output value V3 is the value which corresponds to the position of the third conductive plate 7*c* (the height of the lift plate 63, the thickness of the sheet bundle). As shown in FIG. 18, in the remaining number detection data D3, a no-sheet value and a full-sheet value are defined.

The storage unit 3 stores the no-sheet value as the remaining number detection data D3. The no-sheet value refers to the third output value V3 when in a state where no sheets are set, the paper feed roller 62*a* (the lift plate 63) is raised to the upper limit position. The storage unit 3 also stores the full-sheet value as the remaining number detection data D3. The full-sheet value refers to the third output value V3 when the sheets are fully set.

The number of sheets when the cassette 61 is full is 500 sheets of plain paper. This corresponds to the fact that generally distributed sheets of plain paper are packed in units of 500 sheets. When the cassette 61 is removed, the lift plate 63 falls down. Thereafter, about 500 sheets are set. Then, a gap is provided between the uppermost sheet of the sheet bundle set and the paper feed roller 62*a*. This is because when the cassette 61 is returned, the upper portion of the sheet bundle set is prevented from colliding with the paper feed roller 62*a*. After the sheets are fully set, the lift plate 63 needs to be raised until the uppermost sheet of the bundle is brought into contact with the paper feed roller 62*a*.

The full-sheet value is set to the value which is obtained by adding a reference change amount to a lower limit corresponding value. The lower limit corresponding value refers to the third output value V3 in a state where the lift plate 63 falls down to the lower limit position. The reference change amount is previously determined. The reference change amount refers to the reference amount of change in the third output value V3 when in a state where the sheets are fully set, the paper feed roller 62*a* is raised to the upper limit position.

As described with reference to FIG. 16, the inclination of the third output value V3 is constant. The ratio between the amount of raising of the lift plate 63 (the amount of change in the thickness of the sheets on the lift plate 63) and the amount of raising of the third output value V3 is constant. The third output value V3 linearly changes with the amount of movement of the third conductive plate 7*c*.

The change in the third output value V3 is linear. Hence, the control unit 2 uses the third output value V3, the no-sheet value and the full-sheet value recognized so as to determine the current remaining number of sheets (step #15). The control unit 2 divides the absolute value of a difference between the third output value V3 and the no-sheet value recognized by the absolute value of a difference between the no-sheet value and the full-sheet value. The ratio of the thickness of the current sheet bundle to the thickness of the sheet bundle when the sheets are fully set is determined. Since a proportional relationship is provided, the remaining number detection data D3 can also be set to a linear function of Z (remaining number of sheets)=a (inclination)×X (third output value V3)+b (intercept). In this case, the control unit 2 performs a computation with the linear function so as to determine the remaining number of sheets.

The control unit 2 displays the determined remaining number (ratio) on the display panel 51 (step #16). In this way, the detection of the remaining number of set sheets is completed. The present flow is completed (end). As shown in FIG. 19, the control unit 2 displays the determined remaining number (ratio) on the display panel 51. The determined remaining number (ratio) is displayed in a message display region F1 on each setting screen. On the setting screen of FIG. 19, the message display region F1 is provided in a lower portion of the screen.

(Calculation of the Remaining Number of Sheets)

The calculation of the remaining number of sheets in the paper feed device 1 according to the embodiment will then be described with reference to FIGS. 20 and 21. The resolution of the sensor unit 7 is high. In the paper feed device 1, it is possible to determine the amount of change in the third output value V3 for the thickness of one sheet. The control unit 2 divides the third output value V3 corresponding to the thickness of the sheet bundle set by the third output value V3 for the thickness of one sheet. In this way, it is possible to determine the remaining number of sheets within the cassette 61.

Figure 20:
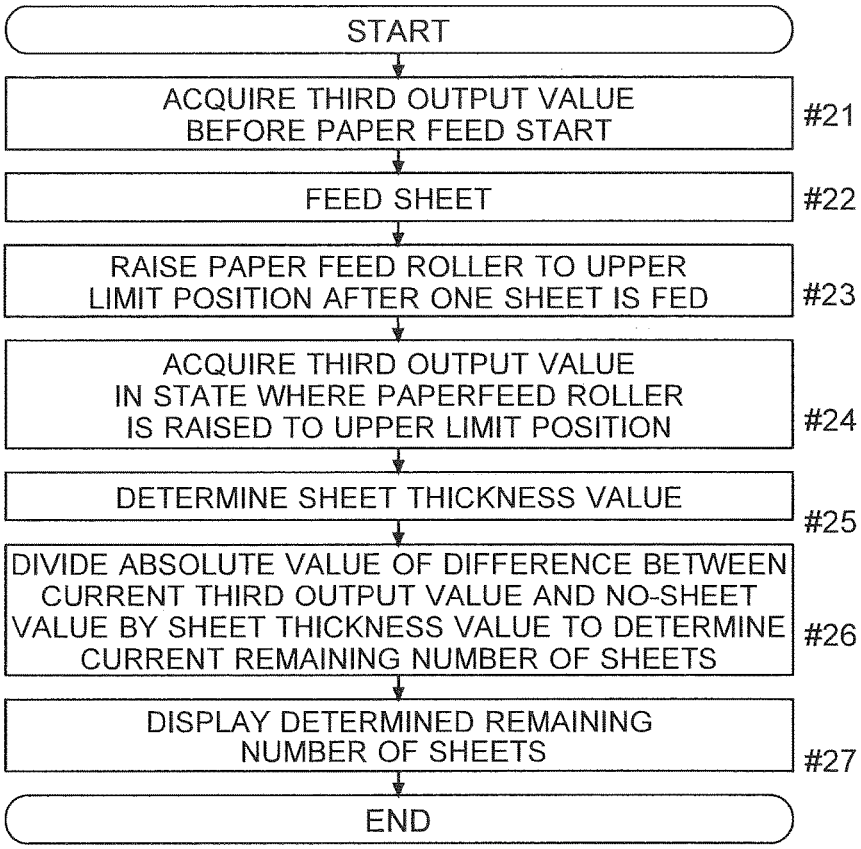
FIG. 20 is a flowchart showing an example of the flow of the calculation of the remaining number of sheets in the embodiment.
Figure 21:
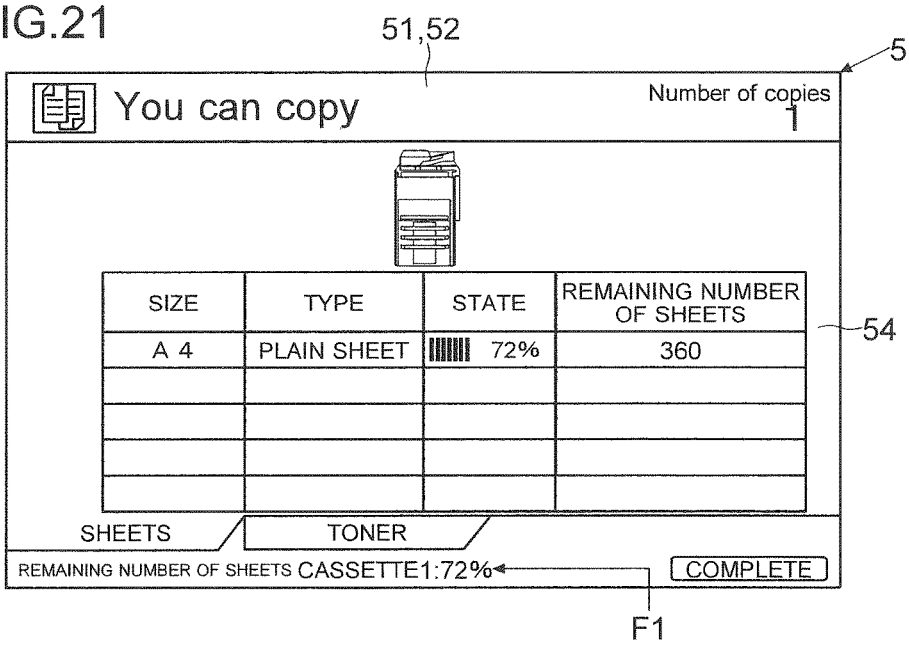
FIG. 21 is a diagram showing an example of a detailed remaining number notification screen in the embodiment.

First, the start of FIG. 20 is the predetermined time when the calculation of the remaining number of sheets is started. In the paper feed device 1, the time when the feeding of the sheet is started is assumed to be the time when the calculation of the remaining number of sheets is started. The control unit 2 acquires and recognizes the third output value V3 before the feeding of the sheet is started (step #21). The control unit 2 feeds the sheet (step #22). The control unit 2 operates the raising motor 67*a* after one sheet is fed so as to raise the paper feed roller 62*a* to the upper limit position (step #23). The control unit 2 acquires and recognizes the third output value V3 in a state where the paper feed roller 62*a* is raised to the upper limit position (step #24).

The control unit 2 determines a sheet thickness value (step #25). The sheet thickness value refers to the absolute value of a difference between the third output value V3 obtained in step #21 and the third output value V3 obtained in step #24. In other words, the control unit 2 determines the amount of change in the third output value V3 corresponding to one sheet.

Then, the control unit 2 determines the current remaining number of sheets (step #26). The control unit 2 divides the absolute value of a difference between the current third output value V3 and the no-sheet value by the sheet thickness value. The absolute value of the difference between the no-sheet value and the current third output value V3 corresponds to the thickness of the remaining sheet bundle. The sheet thickness value corresponds to one sheet. In other words, the control unit 2 divides the value corresponding to the thickness of the remaining sheet bundle by the value corresponding to one sheet. In this way, the remaining number of sheets within the cassette 61 is determined.

A configuration may be adopted in which it is possible to input the thickness of the set sheets to the operation panel 5 (the touch panel 52 and the hard keys 53). Based on the thickness of the sheets which is input, the remaining number of sheets may be determined. For example, when a predetermined operation is performed, the control unit 2 displays, on the display panel 51, a screen for selecting a sheet thickness (paper type) from a plurality of types such as thick paper, plain paper and thin paper. Then, the touch panel 52 receives the selection of the paper type. The storage unit 3 stores, for each paper type, the amount of change in the third output value V3 when one sheet is fed. Based on the data stored in the storage unit 3, the control unit 2 divides the absolute value of a difference between the current third output value V3 and the no-sheet value by the amount of change in the third output value V3 for one sheet corresponding to the selected paper type. In this way, the current remaining number of sheets is determined.

The control unit 2 displays the determined remaining number of sheets on the display panel 51 (step #27). In this way, the detection of the remaining number of sheets is completed. The present flow is completed (end). In the message display region F1, the determined remaining number of sheets may be displayed. Instead of the message display region F1, the control unit 2 may display the remaining number of sheets in a detailed remaining number notification screen 54 (see FIG. 20). When a predetermined operation is performed on the operation panel 5, the control unit 2 displays the detailed remaining number notification screen 54.

(Automatic Updating of No-Sheet Value and Full-Sheet Value)

Automatic updating of the no-sheet value and the full-sheet value in the embodiment will then be described with reference to FIG. 22. The third output value V3 is affected by the distance between the third coil substrate L3 and the third conductive plate 7*c* and the positional relationship thereof. The installation position of the third coil substrate L3 and the position to which the third conductive plate 7*c* is attached within the rotation plate 10 may be slightly displaced in the manufacturing or the assembly. Hence, even when the sheet bundle having the same thickness is set for a plurality of paper feed devices 1, in each of the paper feed devices 1, slight variations in the third output value V3 are produced. A difference is made between the individual paper feed devices 1. It is likely that when the same no-sheet value and full-sheet value are used for any of the paper feed devices 1, the detected remaining number is slightly displaced from the accurate remaining number.

There can be a case where after appropriate no-sheet value and full-sheet value are set in the initial setting at the time of shipment, the cassette 61 is replaced due to a failure. There is also a case where the cassettes 61 are exchanged between the paper feed devices 1. When the replacement or the exchange on the paper feed devices 1 is performed, the no-sheet value and the full-sheet value which are initially set are not necessarily appropriate for the exchanged cassettes 61.

Hence, in the paper feed device 1, the no-sheet value and the full-sheet value are automatically updated. The accurate remaining number is constantly made to be detected. The flow thereof will be described below with reference to FIG. 22. The initial values of the no-sheet value and the full-sheet value may be previously determined. The initial values may be set in an inspection at the time of shipment from a factory according to the flow of FIG. 22.

Figure 22:
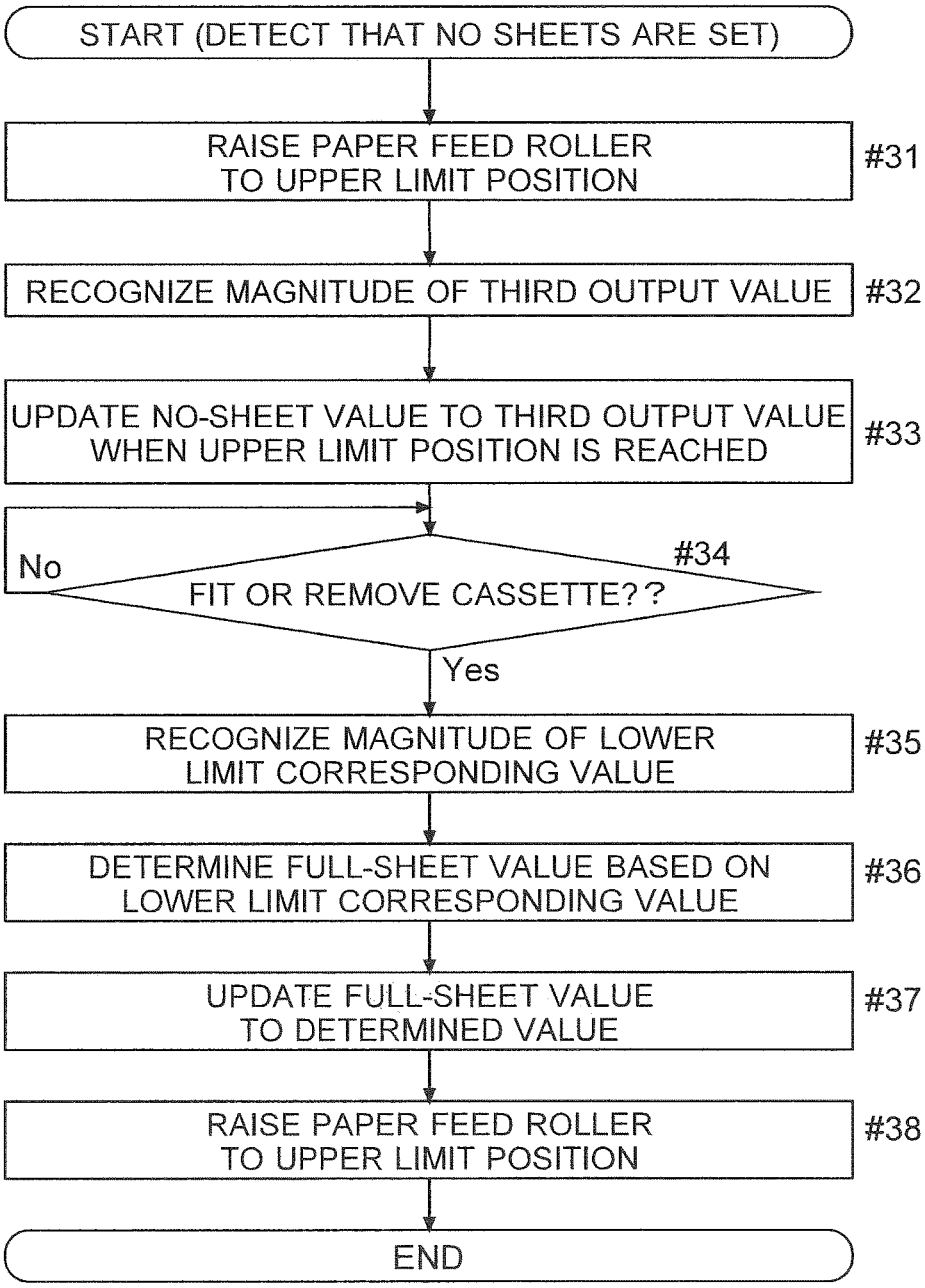
FIG. 22 is a flowchart showing an example of the flow of the automatic updating of a no-sheet value and a full-sheet value in the embodiment.

The start of FIG. 22 is the time when based on the output of the set sensor S3, the control unit 2 recognizes that no sheets are set. When the control unit 2 recognizes that no sheets are set, the control unit 2 raises the lift plate 63 (the paper feed roller 62*a*) to the upper limit position (step #31). The control unit 2 operates the raising motor 67*a* (the raising/lowering mechanism 67). The control unit 2 recognizes the magnitude of the third output value V3 (step #32). The control unit 2 makes the storage unit 3 update the no-sheet value (step #33), and the control unit 2 makes the storage unit 3 store the third output value V3 when the lift plate 63 reaches the upper limit position. In this way, the updating of the no-sheet value is performed.

Based on the output of the fitting/removal sensor S2, the control unit 2 continues to check whether or not the cassette 61 is fitted or removed (removed or pushed back) (step #34, no in step #34→step #34). By the removal of the cassette 61, the lift plate 63 is lowered to the lower limit position.

When the cassette 61 is returned (yes in step #34), the control unit 2 recognizes, as the lower limit corresponding value, the magnitude of the third output value V3 when the lift plate 63 is in the lower limit position (step #35). The control unit 2 determines the full-sheet value based on the lower limit corresponding value (step #36). The control unit 2 stores the determined full-sheet value in the storage unit 3 (step #37). The updating of the full-sheet value is performed. Since the lift plate 63 remains in the state where the lift plate 63 falls down, the control unit 2 operates the raising/lowering mechanism 67. The control unit 2 raises the lift plate 63 to the upper limit position (step #38). Then, the present flow is completed (end).

After the cassette 61 is returned, the control unit 2 raises the lift plate 63. The amount of raising of the lift plate 63 depends on the number of sheets set in the removed cassette 61 and the thickness of the sheet bundle. The sheet bundle may be fully set or the cassette 61 may be returned without the sheets being set. Hence, the third output value V3 when after the cassette 61 is returned, the lift plate 63 is raised to the upper limit position cannot be simply set to the full-sheet value.

Hence, the control unit 2 determines, as the full-sheet value, a value obtained by adding, to the lower limit corresponding value, the reference change amount which is previously determined as the reference amount of change in the third output value V3 when the paper feed roller 62*a* is raised to the upper limit position in a state where the sheets are fully set. The reference change amount is stored in the storage unit 3. The reference change amount can be determined as necessary based on an experiment or the like. For example, the amount of change in the third output value V3 when after the sheets of plain paper recommended by a maker are fully set (500 sheets), the paper feed roller 62*a* is raised from a state where the lift plate 63 is in the lower limit position to the upper limit position can be set to the reference change amount. In this way, it is possible to determine, as the full-sheet value, an appropriately estimated value.

As described above, the paper feed device 1 according to the embodiment includes the cursor, the cassette 61, the raising/lowering mechanism 67, the sensor unit 7, the movement mechanism 8, the storage unit 3 and the control unit 2. The cursor makes contact with sheets which are set so as to regulate the position of the sheets. The cassette 61 includes the lift plate 63 in which the sheets are set on the upper surface and can be removed. The raising/lowering mechanism 67 raises and lowers the lift plate 63. The sensor unit 7 includes a coil substrate on which a coil pattern is printed and a conductive plate which is opposite the coil substrate without making contact therewith, applies a voltage to the coil substrate so as to generate a magnetic field and outputs an output value corresponding to the position of the conductive plate. The movement mechanism 8 is moved in a coordinated manner with at least one of the cursor and the lift plate 63 so as to move the conductive plate parallel to the flat surface of the coil substrate. The storage unit 3 stores data for detecting the size of the sheets or the remaining number of the sheets. The control unit 2 recognizes, based on the magnitude of the output value of the sensor unit 7, at least one of the size of the set sheets and the remaining number of the sheets.

The paper feed device 1 includes: the first cursor 64*a* that severs as the cursor; and the first cursor link mechanism 8*a* that serves as the movement mechanism 8. The first cursor 64*a* can be moved to slide in the direction perpendicular to the transport direction. The sensor unit 7 includes the first coil substrate L1 that serves as the coil substrate, the first conductive plate 7*a* that serves as the conductive plate and the first capacitor C1 that is connected to the first coil substrate L1. The sensor unit 7 applies a voltage to the first coil substrate L1 so as to generate a magnetic field. The sensor unit 7 outputs the first output value V1 corresponding to the position of the first conductive plate 7*a* with respect to the first coil substrate L1. The first conductive plate 7*a* is opposite the first coil substrate L1 without making contact therewith and a width in the direction of the movement is narrowed as compared with the longitudinal direction of the first coil substrate 64*a*. The first cursor link mechanism 8*a* moves, according to the position of the first cursor 64*a*, the first conductive plate 7*a* in the longitudinal direction of the first coil substrate L1. The storage unit 3 stores the first sheet size data D1 for determining the size of the sheets in the direction perpendicular to the transport direction corresponding to the magnitude of the first output value V1. The control unit 2 recognizes, based on the magnitude of the first output value V1 and the first sheet size data D1, the size of the set sheets in the direction perpendicular to the transport direction.

When a current flows through the first coil substrate L1, an eddy current is generated in the first conductive plate 7*a*. Hence, the first coil substrate L1 functions as the primary winding of a transformer, and the magnetic field generated by the eddy current functions as the secondary winding of the transformer. The inductance of the first coil substrate L1 is a value which corresponds to the degree of the magnetic coupling between the first coil substrate L1 and the conductive plate. When the position of the first conductive plate 7*a* is moved from the side of one end of the first coil substrate L1 to the other end, the first output value V1 is continuously (analogically) changed. Based on a significantly high definition (high resolution) output value as compared with a conventional method (method in which a plurality of sensors such as an optical sensor and a contact-type switch are provided), the sheet size in the direction perpendicular to the transport direction can be determined. Thus, it is possible to detect the size of the set sheets with high precision and accuracy. When the sheet of an irregular size is used, it is not necessary to make a setting for the accurate length of the sheets in the direction perpendicular to the transport direction. Moreover, since the first coil substrate L1 and the first conductive plate 7*a* are not brought into contact with each other, no wear occurs. Hence, there is little age deterioration.

The paper feed device 1 includes the second cursor 65 that severs as the cursor and the second cursor link mechanism 9 that serves as the movement mechanism 8. The second cursor 65 can be moved to slide along the transport direction. The sensor unit 7 includes the second coil substrate L2 that serves as the coil substrate, the second conductive plate 7*b* that serves as the conductive plate and the second capacitor C2 that is connected to the second coil substrate L2. The sensor unit 7 applies a voltage to the second coil substrate so as to generate a magnetic field. The sensor unit 7 outputs the second output value V2 corresponding to a resonance frequency that corresponds to the position of the second conductive plate 7*b*. The second conductive plate 7*b* is opposite the second coil substrate L2 without making contact therewith and a width in the direction of the movement is narrowed as compared with the longitudinal direction of the second coil substrate L2. The second cursor link mechanism 9 moves, according to the position of the second cursor 65, the second conductive plate 7*b* in the longitudinal direction of the second coil substrate L2. The storage unit 3 stores the second sheet size data D2 for determining the size of the sheets in the transport direction corresponding to the magnitude of the second output value V2. The control unit 2 recognizes, based on the magnitude of the second output value V2 and the second sheet size data D2, the size of the set sheets in the transport direction.

The second coil substrate L2 functions as the primary winding of a transformer, and the magnetic field generated by the eddy current functions as the secondary winding of the transformer. The second output value V2 is a value which corresponds to the position (resonance frequency) of the second conductive plate 7*b*. In this way, based a significantly high definition (high resolution) output value as compared with the conventional detection method (method in which a plurality of sensors such as an optical sensor and a contact-type switch are provided), the sheet size in the direction parallel to the transport direction can be determined. Thus, it is possible to detect the size of the set sheets with high precision and accuracy. It is also possible to detect both the correct vertical and lateral lengths of the set sheets. When the sheet of an irregular size is used, it is not necessary to make a setting for the sheet size. Moreover, since the second coil substrate L2 and the second conductive plate 7*b* are not brought into contact with each other, no wear occurs. Hence, there is little age deterioration.

The coil pattern P1 of the first coil substrate L1 is formed in the shape of a spiral. The center of the spiral in the coil pattern P1 of the first coil substrate L1 is displaced in the direction of one end of the first coil substrate L1. The amount of extension of the winding wire in the longitudinal direction of the first coil substrate L1 is increased as compared with the amount of extension of the winding wire in the lateral direction of the first coil substrate L1 as the number of windings is increased. The coil pattern P1 of the first coil substrate L1 is formed such that the amount of the winding wire opposite the first conductive plate 7*a* differs according to the position of the first conductive plate 7*a*. In this way, when the first conductive plate 7*a* is moved from the side of one end of the first coil substrate L1 in the longitudinal direction to the side of the other end, the area (amount) of the winding wire opposite the first conductive plate 7*a* is gradually increased or decreased. Hence, the degree of the magnetic coupling between the first coil substrate L1 and the first conductive plate 7*a* can be made to differ according to the position of the first coil substrate L1. It is possible to set the first output value V1 to a value which corresponds to the position of the first conductive plate 7*a*.

The coil pattern P2 of the second coil substrate L2 is formed in the shape of a spiral. The center of the spiral in the coil pattern P2 of the second coil substrate L2 is displaced in the direction of one end of the second coil substrate L1. The amount of extension of the winding wire in the longitudinal direction of the second coil substrate L2 is increased as compared with the amount of extension of the winding wire in the lateral direction of the second coil substrate L2 as the number of windings is increased. The coil pattern P2 of the second coil substrate L2 is formed such that the amount of the winding wire opposite the second conductive plate 7*b* differs according to the position of the second conductive plate 7*b*. In this way, when the second conductive plate 7*b* is moved from the side of one end of the second coil substrate L2 in the longitudinal direction to the side of the other end, the area of the winding wire of the second coil substrate L2 opposite the second conductive plate 7*b* is gradually increased or decreased. Hence, the degree of the magnetic coupling can be made to differ according to the position of the second coil substrate L2. It is possible to set the second output value V2 to a value which corresponds to the position of the second conductive plate 7*b*.

The first coil substrate L1 is attached such that the longitudinal direction is parallel to the transport direction. The first cursor link mechanism 8*a* includes the first gear 81, the first rack 82, the second gear 83 and the second rack 84. The first rack 82 is connected to the first cursor 64*a* and engages with the first gear 81. The second gear 83 engages with the first gear 81. The first conductive plate 7*a* is attached to the second rack 84, and the second rack 84 is opposite the first coil substrate L1. The first rack 82, the first gear 81, the second gear 83 and the second rack 84 convert the movement of the first cursor 64*a* in the direction perpendicular to the transport direction into the movement in the direction parallel to the transport direction. The first conductive plate 7*a* is moved in the longitudinal direction of the first coil substrate L1 according to the position of the first cursor 64*a*. In the first cursor link mechanism 8*a*, the two gears and the two racks are only provided. It is possible to accurately find the size in the direction perpendicular to the transport direction with simple and inexpensive members.

The second coil substrate L2 is attached such that the longitudinal direction is parallel to the transport direction. The second cursor link mechanism 9 is the bar member 91. The bar member 91 has one end connected to the second cursor 65. The bar member 91 has the second conductive plate 7*b* attached to the other end. The bar member 91 is moved according to the position of the second cursor 65 so as to move the second conductive plate 7*b* in the longitudinal direction of the second coil substrate L2. In the second cursor link mechanism 9, the bar member 91 is only provided. It is possible to accurately find the size of the sheets in the transport direction with simple and inexpensive member.

As described in the variation, the second coil substrate L2 is attached such that the longitudinal direction is parallel to the transport direction. The second cursor link mechanism 9 includes the first pulley 92, the second pulley 93, the first belt 94, the third pulley 95, the fourth pulley 96 and the second belt 97. The first belt 94 is placed over the first pulley 92 and the second pulley 93. The first belt 94 is opposite the second coil substrate L2. The first belt 94 has the second conductive plate 7*b* stuck thereto. The second belt 97 is longer than the first belt 94. The second belt 97 is placed over the first pulley 92 or the second pulley 93, the third pulley 95 and the fourth pulley 96. The second belt 97 is connected to the second cursor 65. The first belt 94 and the second belt 97 are rotated in a coordinated manner with the movement of the second cursor 65 so as to move the second conductive plate 7*b* in the longitudinal direction of the second coil substrate L2. In the pulley over which both the first belt 94 and the second belt 97 are placed, the diameter of a part of the pulley over which the first belt 94 is placed is smaller than the diameter of a part of the pulley over which the second belt 97 is placed. The second cursor 65 is moved in the direction parallel to the transport direction. In the pulley over which both the first belt 94 and the second belt 97 are placed, the diameter of the part of the pulley over which the first belt 94 is placed is smaller than the diameter of the part of the pulley over which the second belt 97 is placed. Hence, as compared with the range of the movement of the second cursor 65, the range of the movement of the second conductive plate 7*b* can be shortened. Thus, it is possible to reduce the size of the second conductive plate 7*b*. The first coil substrate L1 and the second coil substrate L2 can be aligned and attached to the wall surface of the paper feed device 1 in the direction parallel to the transport direction.

A voltage (pulse) is input to the third coil substrate L3. When the third coil substrate L3 and the third conductive plate 7*c* are opposite each other, an eddy current is generated in the third conductive plate 7*c*. The third coil substrate L3 and the third conductive plate 7*c* are magnetically coupled to each other. The amount of eddy current generated and the inductance of the third coil substrate L3 are changed according to the area of the third conductive plate 7*c* opposite the third coil substrate L3. Consequently, the third output value V3 is changed according to the area of the third conductive plate 7*c* (the position of the third conductive plate 7*c*) opposite the third coil substrate L3.

The paper feed device 1 includes the paper feed roller 62*a* that is swung in an up/down direction, that is provided above the lift plate 63 and that feeds out the sheets set on the lift plate 63. The sensor unit 7 includes the third coil substrate L3 that serves as the coil substrate, the third conductive plate 7*c* that serves as the conductive plate and the third capacitor C3 that is connected to the third coil substrate L3. The sensor unit 7 applies a voltage to the third coil substrate L3 so as to generate a magnetic field. The sensor unit 7 outputs the third output value V3 corresponding to the position of the third conductive plate 7*c*. The third conductive plate 7*c* is opposite the third coil substrate L3 without making contact therewith. The movement mechanism 8 moves the third conductive plate 7*c* parallel to the flat surface of the third coil substrate L3. The movement mechanism 8 moves the third conductive plate 7*c* such that the area of the third conductive plate 7*c* opposite the third coil substrate L3 is increased or decreased according to the height of the lift plate 63. The storage unit 3 stores the remaining number detection data D3 for determining the current remaining number of the sheets corresponding to the third output value V3. The control unit 2 determines, based on the magnitude of the third output value V3 and the remaining number detection data D3, the current remaining number of the sheets. In this way, the output of the sensor unit 7 is analogically changed according to the area of the third conductive plate 7*c* (the height of the lift plate 63) opposite the third coil substrate L3. Based on the output of the sensor unit 7, the remaining number of sheets is recognized. It is possible to detect the remaining number of sheets accurately and stepwise.

The sensor unit 7 changes the third output value V3 proportionally to the amount of change (the remaining number of sheets) in the height of the lift plate 63. In this way, it is possible to provide a proportional relationship between the height of the lift plate 63 and the third output value V3 of the sensor unit 7, and thus it is possible to detect the accurate remaining number of sheets.

The paper feed device 1 includes the display panel 51 that displays the remaining number determined by the control unit 2. The storage unit 3 stores, as the remaining number detection data D3, the no-sheet value that is the third output value V3 when in a state where no sheets are set, the paper feed roller 62*a* is raised to the upper limit position by the raising of the lift plate 63. The storage unit 3 stores, as the remaining number detection data D3, the full-sheet value that is the third output value V3 when the sheets are fully set. The control unit 2 divides the absolute value of a difference between the recognized third output value V3 and the no-sheet value by the absolute value of a difference between the no-sheet value and the full-sheet value so as to determine the current remaining number of the sheets. The control unit 2 displays the determined remaining number of sheets on the display panel 51. The height of the lift plate 63 and the third output value V3 have a proportional relationship. Based on the ratio between the range from the full-sheet value to the no-sheet value and the current third output value V3, it is possible to determine the accurate remaining number of sheets. The ratio of the "thickness of the sheet bundle set at present" to the "thickness of the sheet bundle when the sheets are fully set" can be determined as the remaining number of sheets. It is possible to notify the user of the accurate remaining number of sheets.

The paper feed device 1 includes the upper limit sensor S1, the set sensor S3 and the fitting/removal sensor S2. The upper limit sensor S1 detects that the paper feed roller 62*a* is lifted up to the upper limit position by the lift plate 63. The set sensor S3 detects whether or not the set sheets are present. The fitting/removal sensor S2 detects whether or not the cassette 61 is attached. When the cassette 61 is removed, the raising/lowering mechanism 67 lowers the lift plate 63 to the lower limit position. The control unit 2 recognizes, based on the output of the set sensor S3, that no sheets are set.

When the control unit 2 recognizes that no sheets are set, the control unit 2 makes, based on the output of the upper limit sensor S1, the raising/lowering mechanism 67 raise the lift plate 63 until the paper feed roller 62*a* reaches the upper limit position. The control unit 2 stores, as the no-sheet value, in the storage unit 3, the third output value V3 when the paper feed roller 62*a* reaches the upper limit position. When the control unit 2 recognizes, based on the output of the fitting/removal sensor S2, that the cassette 61 is removed or fitted, the control unit 2 recognizes the lower limit corresponding value that is the third output value V3 in a state where the lift plate 63 falls down to the lower limit position. The control unit 2 stores, as the full-sheet value, in the storage unit 3, a value obtained by adding the reference change amount to the lower limit corresponding value. The reference change amount is previously determined and is a reference amount of change in the third output value V3 when in a state where the sheets are fully set, the paper feed roller 62*a* is raised to the upper limit position. In this way, it is possible to store the accurate no-sheet value and full-sheet value corresponding to individual variations in the sheet cassette 61 and the sensor unit 7. Even when the cassettes 61 are exchanged, the accurate no-sheet value and full-sheet value can be stored. Hence, even when a failure or an exchange occurs, the accurate remaining number of sheets can be detected and notified to the user.

The control unit 2 determines, as the sheet thickness value indicating the thickness of one sheet, the absolute value of a difference between the third output value V3 after one sheet is fed and the third output value V3 when the paper feed roller 62*a* is raised to the upper limit position after one sheet is fed. The control unit 2 divides the absolute value of a difference between the current third output value V3 and the no-sheet value by the sheet thickness value so as to determine the current remaining number of the sheets. The control unit 2 displays the determined remaining number on the display panel 51. In this way, it is possible to determine the third output value V3 which corresponds to the thickness of one sheet. The width of the third output value V3 which corresponds to the thickness of the sheet bundle is divided by the sheet thickness value. In this way, it is possible to accurately determine the remaining number of sheets. Then, it is possible to notify the accurate remaining number of sheets to the user.

The paper feed device 1 includes an input portion (the touch panel 52 and the hard keys 53) that inputs the thickness of the set sheets. The control unit 2 determines the amount of change in the third output value V3 before and after feeding of the sheets of the thickness set by the input portion. The control unit 2 divides the absolute value of a difference between the current third output value V3 and the no-sheet value by the amount of change so as to determine the current remaining number of the sheets. The control unit 2 displays the determined remaining number of sheets on the display panel. In this way, it is possible to accurately determine the remaining number of sheets. Then, it is possible to notify the accurate remaining number of sheets to the user.

The raising/lowering mechanism 67 includes the drive shaft 67*b* and the raising motor 67*a* that rotates the drive shaft 67*b*. The push-up member 67*c* that lifts up and raises the lift plate 63 is attached to the drive shaft 67*b*. The rotation plate 10 is attached as the movement mechanism 8. The rotation plate 10 is attached to the drive shaft 67*b*. The rotation angle of the rotation plate 10 is changed according to the rotation angle of the drive shaft 67*b*. The third conductive plate 7*c* is formed substantially in the shape of a triangle. The third conductive plate 7*c* is attached to the rotation plate 10. The third coil substrate L3 is provided opposite the rotation plate 10. As the lift plate 63 is raised, the rotation plate 10 brings the third conductive plate 7*c* closer to the center of the third coil substrate L3 when seen from the flat surface of the third coil substrate L3. As the lift plate 63 is raised, the rotation plate 10 increases the area of the third conductive plate 7*c* opposite the third coil substrate L3. In this way, it is possible to increase the area of the third conductive plate 7*c* opposite the third coil substrate L3 proportionally to the amount of raising of the lift plate 63. It is possible to reduce the area of the third conductive plate 7*c* opposite the third coil substrate L3 proportionally to the amount of lowering of the lift plate 63. Hence, it is possible to change the third output value V3 proportionally to the amount of movement of the lift plate 63 (the remaining number of sheets).

The image forming apparatus (multifunctional peripheral 100) includes the paper feed device 1. It is possible to provide the image forming apparatus that can detect the size of the sheets and the remaining number of sheets accurately and stepwise. It is possible to provide the image forming apparatus that notifies the user of the size of the sheets and the remaining number of sheets detected.

Although the embodiment of the present disclosure is described above, the scope of the present disclosure is not limited to this embodiment, and the present disclosure can be practiced by adding various variations thereto without departing from the spirit of the disclosure.

What is claimed is:

1. A paper feed device comprising:

a cursor that makes contact with sheets which are set so as to regulate a position of the sheets;

a cassette that includes a lift plate in which the sheets are set on an upper surface and that can be removed;

a raising/lowering mechanism that raises and lowers the lift plate;

a sensor unit that includes a coil substrate on which a coil pattern is printed and a conductive plate which is opposite the coil substrate without making contact therewith, that applies a voltage to the coil substrate so as to generate a magnetic field and that outputs an output value corresponding to a position of the conductive plate;

a movement mechanism that is moved in a coordinated manner with at least one of the cursor and the lift plate so as to move the conductive plate parallel to a flat surface of the coil substrate;

a storage unit that stores data for detecting a size of the sheets;

a control unit that recognizes, based on a magnitude of the output value of the sensor unit, the size of the set sheets;

a first cursor that serves as the cursor; and a first cursor link mechanism that serves as the movement mechanism, wherein the first cursor can be moved to slide in a direction perpendicular to a transport direction, the sensor unit includes a first coil substrate that serves as the coil substrate, a first conductive plate that serves as the conductive plate and a first capacitor that is connected to the first coil substrate, applies a voltage to the first coil substrate so as to generate a magnetic field and outputs a first output value corresponding to a position of the first conductive plate with respect to the first coil substrate, the first conductive plate is opposite the first coil substrate without making contact therewith and a width in a direction of a movement is narrowed as compared with a longitudinal direction of the first coil substrate, the first cursor link mechanism moves, according to a position of the first cursor, the first conductive plate in the longitudinal direction of the first coil substrate, the storage unit stores first sheet size data for determining a size of the sheets in the direction perpendicular to the transport direction corresponding to a magnitude of the first output value and the control unit recognizes, based on the magnitude of the first output value and the first sheet size data, the size of the set sheets in the direction perpendicular to the transport direction, the coil pattern of the first coil substrate is formed in a shape of a spiral, a center of the spiral in the coil pattern of the first coil substrate is displaced in a direction of one end of the first coil substrate, an amount of extension of a winding wire in the longitudinal direction of the first coil substrate is increased as compared with an amount of extension of the winding wire in a lateral direction of the first coil substrate as a number of windings is increased and the coil pattern of the first coil substrate is formed such that an amount of the winding wire opposite the first conductive plate differs according to the position of the first conductive plate.

2. The paper feed device according to claim 1, comprising:

a second cursor that serves as the cursor; and a second cursor link mechanism that serves as the movement mechanism, wherein the second cursor can be moved to slide along a transport direction, the sensor unit includes a second coil substrate that serves as the coil substrate, a second conductive plate that serves as the conductive plate and a second capacitor that is connected to the second coil substrate, applies a voltage to the second coil substrate so as to generate a magnetic field and outputs a second output value corresponding to a resonance frequency that corresponds to a position of the second conductive plate, the second conductive plate is opposite the second coil substrate without making contact therewith and a width in a direction of a movement is narrowed as compared with a longitudinal direction of the second coil substrate, the second cursor link mechanism moves, according to a position of the second cursor, the second conductive plate in the longitudinal direction of the second coil substrate, the storage unit stores second sheet size data for determining a size of the sheets in the transport direction corresponding to a magnitude of the second output value and the control unit recognizes, based on the magnitude of the second output value and the second sheet size data, the size of the set sheets in the transport direction.

3. The paper feed device according to claim 2, wherein the coil pattern of the second coil substrate is formed in a shape of a spiral, a center of the spiral in the coil pattern of the second coil substrate is displaced in a direction of one end of the second coil substrate, an amount of extension of a winding wire in the longitudinal direction of the second coil substrate is increased as compared with an amount of extension of the winding wire in a lateral direction of the second coil substrate as a number of windings is increased and the coil pattern of the second coil substrate is formed such that an amount of the winding wire opposite the second conductive plate differs according to the position of the second conductive plate.

4. The paper feed device according to claim 2, wherein the second coil substrate is attached such that the longitudinal direction is parallel to the transport direction, the second cursor link mechanism is a bar member and the bar member has one end connected to the second cursor, has the second conductive plate attached to the other end and is moved according to the position of the second cursor so as to move the second conductive plate in the longitudinal direction of the second coil substrate.

5. The paper feed device according to claim 2, wherein the second coil substrate is attached such that the longitudinal direction of the second coil substrate is parallel to the transport direction, the second cursor link mechanism includes a first pulley, a second pulley, a first belt, a third pulley, a fourth pulley and a second belt, the first belt is placed over the first pulley and the second pulley, is opposite the second coil substrate and has the second conductive plate stuck thereto, the second belt is longer than the first belt, is placed over the first pulley or the second pulley, the third pulley and the fourth pulley and is connected to the second cursor, the first belt and the second belt are rotated in a coordinated manner with the movement of the second cursor so as to move the second conductive plate in the longitudinal direction of the second coil substrate and in the pulley of the first pulley and the second pulley over which both the first belt and the second belt are placed, a diameter of a part of the pulley over which the first belt is placed is smaller than a diameter of a part of the pulley over which the second belt is placed.

6. An image forming apparatus comprising the paper feed device according to claim 1.

7. The paper feed device according to claim 2, further comprising:

a paper feed roller that is swung in an up/down direction, that is provided above the lift plate and that feeds out the sheets set on the lift plate, wherein the sensor unit includes a third coil substrate that serves as the coil substrate, a third conductive plate that serves as the conductive plate and a third capacitor that is connected to the third coil substrate, applies a voltage to the third coil substrate so as to generate a magnetic field and outputs a third output value corresponding to a position of the third conductive plate, the third conductive plate is opposite the third coil substrate without making contact therewith, the movement mechanism moves the third conductive plate parallel to a flat surface of the third coil substrate and moves the third conductive plate such that an area of the third conductive plate opposite the third coil substrate is increased or decreased according to a height of the lift plate, the storage unit stores remaining number detection data for determining the current remaining number of the sheets corresponding to the third output value and the control unit determines, based on the magnitude of the third output value and the remaining number detection data, the current remaining number of the sheets.

8. A paper feed device comprising:

a cursor that makes contact with sheets which are set so as to regulate a position of the sheets;

a cassette that includes a lift plate in which the sheets are set on an upper surface and that can be removed;

a raising/lowering mechanism that raises and lowers the lift plate;

a sensor unit that includes a coil substrate on which a coil pattern is printed and a conductive plate which is opposite the coil substrate without making contact therewith, that applies a voltage to the coil substrate so as to generate a magnetic field and that outputs an output value corresponding to a position of the conductive plate;

a cursor link mechanism that is moved in a coordinated manner with the cursor and so as to move the conductive plate parallel to a flat surface of the coil substrate;

a storage unit that stores data for detecting a size of the sheets;

a control unit that recognizes, based on a magnitude of the output value of the sensor unit, the size of the set sheets, wherein the cursor can be moved to slide in a direction perpendicular to a transport direction, the sensor unit includes a capacitor that is connected to the coil substrate, applies a voltage to the coil substrate so as to generate a magnetic field and outputs a output value corresponding to a position of the conductive plate with respect to the coil substrate, the conductive plate is opposite the coil substrate without making contact therewith and a width in a direction of a movement is narrowed as compared with a longitudinal direction of the coil substrate, the storage unit stores sheet size data for determining a size of the sheets in the direction perpendicular to the transport direction corresponding to a magnitude of the output value and the control unit recognizes, based on the magnitude of the output value and the sheet size data, the size of the set sheets in the direction perpendicular to the transport direction, the coil substrate is attached such that the longitudinal direction is parallel to the transport direction, the cursor link mechanism includes a first gear, a first rack, a second gear and a second rack, the first rack is connected to the cursor and engages with the first gear, the second gear engages with the first gear, the conductive plate is attached to the second rack, and the second rack is opposite the first coil substrate and the first rack, the first gear, the second gear and the second rack convert a movement of the cursor in the direction perpendicular to the transport direction into a movement in a direction parallel to the transport direction so as to move, according to the position of the cursor, the conductive plate in the longitudinal direction of the first coil substrate.

9. A paper feed device comprising:

a cursor that makes contact with sheets which are set so as to regulate a position of the sheets;

a cassette that includes a lift plate in which the sheets are set on an upper surface and that can be removed;

a raising/lowering mechanism that raises and lowers the lift plate;

a sensor unit that includes a coil substrate on which a coil pattern is printed and a conductive plate which is opposite the coil substrate without making contact therewith, that applies a voltage to the coil substrate so as to generate a magnetic field and that outputs an output value corresponding to a position of the conductive plate;

a movement mechanism that is moved in a coordinated manner with the lift plate so as to move the conductive plate parallel to a flat surface of the coil substrate;

a storage unit that stores data for detecting a remaining number of the sheets;

a control unit that recognizes, based on a magnitude of the output value of the sensor unit, the remaining number of the sheets; and a paper feed roller that is swung in an up/down direction, that is provided above the lift plate and that feeds out the sheets set on the lift plate, wherein the sensor unit includes a capacitor that is connected to the coil substrate, applies a voltage to the coil substrate so as to generate a magnetic field and outputs a output value corresponding to a position of the conductive plate, the conductive plate is opposite the coil substrate without making contact therewith, the movement mechanism moves the conductive plate parallel to a flat surface of the coil substrate and moves the conductive plate such that an area of the conductive plate opposite the coil substrate is increased or decreased according to a height of the lift plate, the storage unit stores remaining number detection data for determining the current remaining number of the sheets corresponding to the output value, the control unit determines, based on the magnitude of the output value and the remaining number detection data, the current remaining number of the sheets, the raising/lowering mechanism includes a drive shaft and a raising motor that rotates the drive shaft, a push-up member that lifts up and raises the lift plate is attached to the drive shaft, a rotation plate is attached as the movement mechanism, the rotation plate is attached to the drive shaft, and a rotation angle thereof is changed according to a rotation angle of the drive shaft, the conductive plate is formed substantially in a shape of a triangle and is attached to the rotation plate, the coil substrate is provided opposite the rotation plate, as the lift plate is raised, the rotation plate brings the conductive plate closer to a center of the coil substrate when seen from the flat surface of the coil substrate and as the lift plate is raised, the rotation plate increases the area of the conductive plate opposite the coil substrate.

10. The paper feed device according to claim 9, wherein the sensor unit changes the output value proportionally to an amount of change in the height of the lift plate.

11. The paper feed device according to claim 10, further comprising:

a display panel that displays the remaining number determined by the control unit, wherein the storage unit stores, as the remaining number detection data, a no-sheet value that is the output value when in a state where no sheets are set, the lift plate and the paper feed roller are raised to an upper limit position and a full-sheet value that is the output value when the sheets are fully set, and the control unit divides an absolute value of a difference between the recognized output value and the no-sheet value by an absolute value of a difference between the no-sheet value and the full-sheet value so as to determine the current remaining number of the sheets and displays the determined remaining number of the sheets on the display panel.

12. The paper feed device according to claim 11, further comprising:

an upper limit sensor that detects that the paper feed roller is lifted up to the upper limit position by the lift plate;

a set sensor that detects whether or not the set sheets are present; and a fitting/removal sensor that detects whether or not the cassette is attached, wherein when the cassette is removed, the raising/lowering mechanism lowers the lift plate to a lower limit position, when the control unit recognizes, based on an output of the set sensor, that no sheets are set, the control unit makes, based on an output of the upper limit sensor, the raising/lowering mechanism raise the lift plate until the paper feed roller reaches the upper limit position and stores, as the no-sheet value, in the storage unit, the output value when the paper feed roller reaches the upper limit position, when the control unit recognizes, based on an output of the fitting/removal sensor, that the cassette is removed or fitted, the control unit recognizes a lower limit corresponding value that is the third output value in a state where the lift plate falls down to the lower limit position and sets a value obtained by adding a reference change amount to the lower limit corresponding value to the full-sheet value and stores the full-sheet value in the storage unit and the reference change amount is previously determined and is a reference amount of change in the output value when in a state where the sheets are fully set, the paper feed roller is raised to the upper limit position.

13. The paper feed device according to claim 11, further comprising:

an upper limit sensor that detects that the paper feed roller is lifted up to the upper limit position by the lift plate, wherein the control unit determines, as a sheet thickness value indicating a thickness of one sheet, an absolute value of a difference between the third output value after one sheet is fed and the output value when the paper feed roller is raised to the upper limit position after one sheet is fed, divides an absolute value of a difference between the current third output value and the no-sheet value by the sheet thickness value so as to determine the current remaining number of the sheets and displays the determined remaining number on the display panel.

14. The paper feed device according to claim 11, further comprising:

an input portion that inputs a thickness of the set sheets, wherein the control unit determines an amount of change in the output value before and after feeding of the sheets of the thickness set by the input portion, divides an absolute value of a difference between the current output value and the no-sheet value by the amount of change so as to determine the current remaining number of the sheets and displays the determined remaining number of the sheets on the display panel.

* * * * *